US010286655B2

(12) United States Patent
Abe

(10) Patent No.: US 10,286,655 B2
(45) Date of Patent: May 14, 2019

(54) LIQUID EJECTING APPARATUS AND CAPACITIVE LOAD DRIVE CIRCUIT

(71) Applicant: SEIKO EPSON CORPORATION, Tokyo (JP)

(72) Inventor: Akira Abe, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/859,977

(22) Filed: Jan. 2, 2018

(65) Prior Publication Data

US 2018/0250933 A1 Sep. 6, 2018

(30) Foreign Application Priority Data

Mar. 6, 2017 (JP) ..... 2017-041361

(51) Int. Cl.
*B41J 2/045* (2006.01)

(52) U.S. Cl.
CPC ..... *B41J 2/04541* (2013.01); *B41J 2/0455* (2013.01); *B41J 2/04548* (2013.01); *B41J 2/04581* (2013.01); *B41J 2/04593* (2013.01)

(58) Field of Classification Search
CPC ..... B41J 2/04541
See application file for complete search history.

(56) References Cited

U.S. PATENT DOCUMENTS 9,592,665 B1 * 3/2017 Vasic ..... B41J 2/04541
2004/0252147 A1 * 12/2004 Sumi ..... B41J 2/04581 347/9
2014/0285555 A1 * 9/2014 Otsuka ..... B41J 2/04541 347/11
2014/0285556 A1 9/2014 Otsuka et al.
2016/0271938 A1 * 9/2016 Abe ..... B41J 2/04541
2017/0250679 A1 * 8/2017 Abe ..... B41J 2/04593

FOREIGN PATENT DOCUMENTS

JP 2010-114711 A 5/2010
JP 2014-184569 A 10/2014

* cited by examiner

*Primary Examiner* — Shelby L Fidler

(57) ABSTRACT

A drive circuit includes a first transistor pair, a second transistor pair, a feeder line 290*g* for a ground Gnd, a feeder line 290*a* to which a voltage $V_A$ is applied, a feeder line 290*b* a voltage $V_B$ is applied, and capacitors Cag and Cba, and the first transistor pair amplifies a signal ain within a range from the ground Gnd to the voltage $V_A$, and the second transistor pair amplifies the signal ain within a range from the voltage $V_A$ to the voltage $V_B$, and one end of the capacitor Cag is connected to the feeder line 290*g*, the other end of the capacitor Cag is connected to the feeder line 290*a*, one end of the capacitor Cba is connected to the feeder line 290*a*, and the other end of the capacitor Cba is connected to the feeder line 290*b*.

9 Claims, 12 Drawing Sheets

<DECODED CONTENT OF DECODER>

| | PRINT DATA SI | T1 | | T2 | |
|---|---|---|---|---|---|
| | | Sa | Sb | Sa | Sb |
| LARGE DOT | (1, 1) | H | L | H | L |
| MEDIUM DOT | (0, 1) | H | L | L | H |
| SMALL DOT | (1, 0) | L | L | L | H |
| NON-RECORD DOT | (0, 0) | L | H | L | L |

MSB LSB

LIQUID EJECTING APPARATUS AND CAPACITIVE LOAD DRIVE CIRCUIT

BACKGROUND

1. Technical Field

The present invention relates to a liquid ejecting apparatus and a capacitive load drive circuit.

2. Related Art

As an ink jet printer that ejects ink and prints an image and a document, an ink jet printer using a piezoelectric element is known. Piezoelectric elements are provided to correspond to nozzles in a head unit and are driven in accordance with drive signals. As a result of driving the piezoelectric elements, a specific amount of ink (liquid) is ejected from the nozzle at a specific timing to form a dot. Electrically, the piezoelectric element is a capacitive load such as a capacitor, and therefore it is necessary that a sufficient current be supplied to operate the piezoelectric element of each nozzle.

Therefore, the ink jet printer is configured to amplify a source drive signal, which is a source of the drive signal, by using an amplifier circuit, supply the amplified source drive signal to the head unit as the drive signal, and thus drive the piezoelectric element. For example, class D amplification has been proposed for the amplifier circuit (see JP-A-2010-114711). Briefly speaking, a source drive signal is amplified in class D amplification by pulse-modulating the source drive signal, switching between a high-side transistor and a low-side transistor that have been inserted in series between power sources that supply respective voltages in accordance with the modulated signal, and smoothing the resultant signal of the switching through a low pass filter.

However, in the class D amplification scheme, although the energy efficiency is higher than in a linear amplification scheme, there is room for improvement in terms of power consumption.

SUMMARY

An advantage of some aspects of the invention is to provide a liquid ejecting apparatus in which power consumption is further improved, and a capacitive load drive circuit.

A liquid ejecting apparatus according to an aspect of the invention includes an amplifier circuit that amplifies a source drive signal by using a first voltage, a second voltage higher than the first voltage, a third voltage higher than the second voltage, and a fourth voltage higher than the third voltage and outputs an amplified drive signal via a specific output terminal, and an ejection section that includes a piezoelectric element driven by the drive signal and ejects liquid in response to displacement of the piezoelectric element. The amplifier circuit includes a first transistor pair, a second transistor pair, a first feeder line to which the first voltage is applied, a second feeder line to which the second voltage is applied, a third feeder line to which the third voltage is applied, a fourth feeder line to which the fourth voltage is applied, a first capacitor, and a second capacitor. The first transistor pair amplifies the source drive signal to have a voltage within a range from the first voltage to the second voltage. The second transistor pair amplifies the source drive signal to have a voltage within a range from the third voltage to the fourth voltage. One end of the first capacitor is connected to the first feeder line and the other end of the first capacitor is connected to the second feeder line. One end of the second capacitor is connected to the third feeder line and the other end of the second capacitor is connected to the fourth feeder line.

In the liquid ejecting apparatus according to the aspect of the invention, the power consumption can be further improved compared with the class D amplification scheme.

The second feeder line and the third feeder line may be combined or separated.

In the liquid ejecting apparatus according to the aspect of the invention, it is preferable that a capacitance of the piezoelectric element in a case where a high voltage is applied to the piezoelectric element is smaller than in a case where a low voltage is applied to the piezoelectric element.

In such a configuration, the amplification circuit may include a third capacitor one end of which is connected to the second feeder line and the other end of which is connected to a ground, and a capacitance of the third capacitor may be larger than a capacitance of the first capacitor. The amplification circuit may include a fourth capacitor one end of which is connected to the fourth feeder line and the other end of which is connected to the ground, and the capacitance of the third capacitor may be larger than a capacitance of the fourth capacitor.

It is preferable that the amplifier circuit includes a differential amplifier that outputs a difference signal obtained by amplifying a difference voltage between the source drive signal and a signal based on the drive signal, and a selection section, the first transistor pair includes a first low-side transistor connected between the output terminal and the first feeder line, and a first high-side transistor connected between the second feeder line and the output terminal, the second transistor pair includes a second low-side transistor connected between the output terminal and the third feeder line, and a second high-side transistor connected between the fourth feeder line and the output terminal, and the selection section supplies: the difference signal to a gate terminal of the first low-side transistor when a voltage of the source drive signal is in a specific first range in a first case in which the voltage of the source drive signal changes to decrease and a degree of the voltage change exceeds a threshold value, the difference signal to a gate terminal of the first high-side transistor when the voltage of the source drive signal is in the first range in a second case in which the voltage of the source drive signal changes to increase and the degree of the voltage change exceeds the threshold value, the difference signal to a gate terminal of the second low-side transistor when the voltage of the source drive signal is in a second range higher than the first range in the first case, and the difference signal to a gate terminal of the second high-side transistor when the voltage of the source drive signal is in the second range in the second case.

The selection section may supply signals causing the first high-side transistor and the second high-side transistor to respectively switch off to the gate terminals of the first and second high-side transistors in the first case, and supply signals causing the first low-side transistor and the second low-side transistor to respectively switch off to the gate terminals of the first and second low-side transistors in the second case.

The selection section may supply signals causing the first low-side transistor, the second low-side transistor, the third high-side transistor, and the fourth high-side transistor, to the gate terminals of the transistors to respectively switch off when the degree of the voltage change in the source drive signal is the threshold value or less.

The selection section may control each of the signals supplied to the corresponding gate terminal, based on a specification signal indicating whether the voltage change in the source drive signal is the threshold value or less.

The liquid ejecting apparatus according to the aspect of the invention includes any liquid ejecting apparatus as long as it ejects liquid, and includes a three-dimensional modeling device (3D printer) and a textile printing apparatus in addition to a printing apparatus described later.

In addition, the aspect of the invention is not limited to the liquid ejecting apparatus, and the invention can be realized in various aspects, and can be conceived, for example, as a drive circuit that drives a capacitive load such as the piezoelectric element.

BRIEF DESCRIPTION OF THE DRAWINGS

The invention will be described with reference to the accompanying drawings, wherein like numbers reference like elements.

DESCRIPTION OF EXEMPLARY EMBODIMENTS

The embodiments of the invention using a printing apparatus as an example are described below with reference to the drawings.

Figure 1:
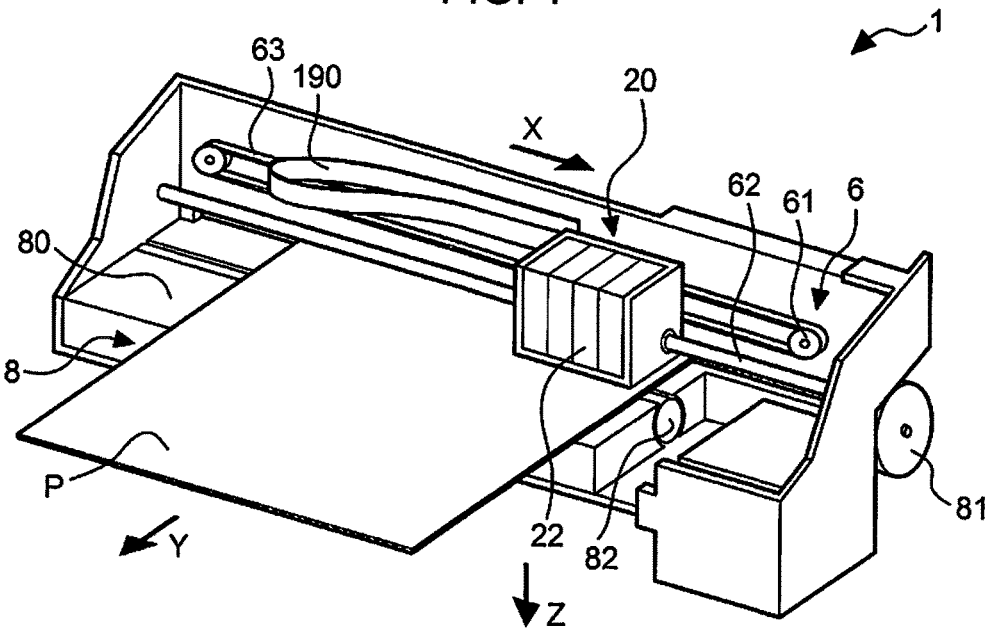
FIG. 1 is a diagram illustrating a schematic configuration of a printing apparatus.

FIG. 1 is a perspective view illustrating a schematic configuration of a printing apparatus 1.

The printing apparatus 1 illustrated in FIG. 1 is a type of a liquid ejecting apparatus that prints an image (including characters, a figure, or the like) by ejecting ink, which is an example of a liquid, and forming an ink dot group on a medium P, such as paper.

As illustrated in FIG. 1, the printing apparatus 1 includes a movement mechanism 6 by which a carriage 20 is moved (reciprocates) in the main scanning direction (X direction).

The movement mechanism 6 includes a carriage motor 61 that moves the carriage 20, a carriage guide shaft 62, both ends of which are fixed, and a timing belt 63 that extends almost parallel to the carriage guide shaft 62 and is driven by the carriage motor 61.

The carriage 20 is supported by the shaft 62 to be able to reciprocate and is fixed to a part of the timing belt 63. Therefore, when the timing belt 63 is caused to run forward or in reverse by the carriage motor 61, the carriage 20 guided by the carriage guide shaft 62 reciprocates.

A print head 22 is mounted on the carriage 20. The print head 22 includes a plurality of nozzles, each of which individually ejects ink in the Z direction, in a portion that faces the medium P. The print head 22 is schematically divided into four blocks for color printing. Each of the four blocks ejects a corresponding color of ink such as cyan (C), magenta (M), yellow (Y), or black (K).

Various control signals and the like are supplied to the carriage 20 from a main substrate (not illustrated) through a flexible flat cable 190.

The printing apparatus 1 includes a transport mechanism 8 by which the medium P is transported on a platen 80. The transport mechanism 8 includes a transport motor 81 that is a drive source and a transport roller 82 that is rotated by the transport motor 81 and transports the medium P in the sub-scanning direction (Y direction).

In such a configuration, an image is formed on the surface of the medium P when an operation to transport the medium P by using the transport mechanism 8 is repeated while ink is ejected in accordance with print data from the nozzles of the print head 22 along with the main scanning of the carriage 20.

In the embodiment, the main scanning is performed when the carriage 20 is moved, but may also be performed when the medium P is moved, or when both the carriage 20 and the medium P are moved. That is, it is sufficient that the medium P and the carriage 20 (print head 22) move relatively to each other.

Figure 2:
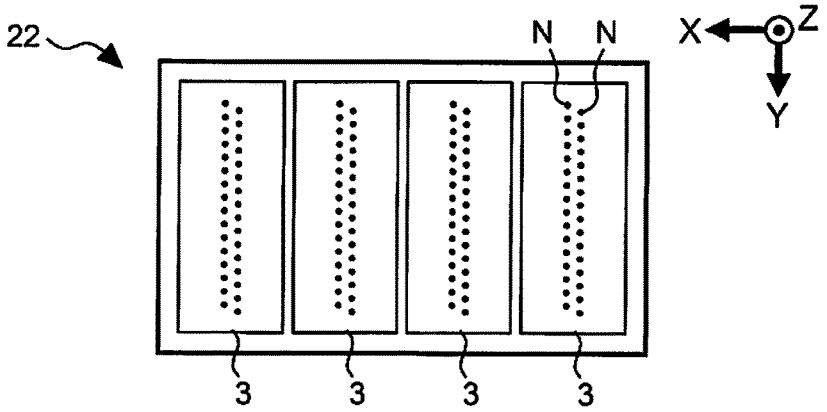
FIG. 2 is a diagram illustrating an array of nozzles in a head unit of the printing apparatus.

FIG. 2 is a diagram illustrating a configuration of an ink ejection surface when the ink ejection surface of the print head 22 is viewed from the medium P. As illustrated in FIG. 2, the print head 22 includes four head units 3. Each of the four head units 3 corresponds to a color of cyan (C), magenta (M), yellow (Y), or black (K), and the four head units 3 are arrayed along the X direction, which is the main scanning direction.

Figure 3:
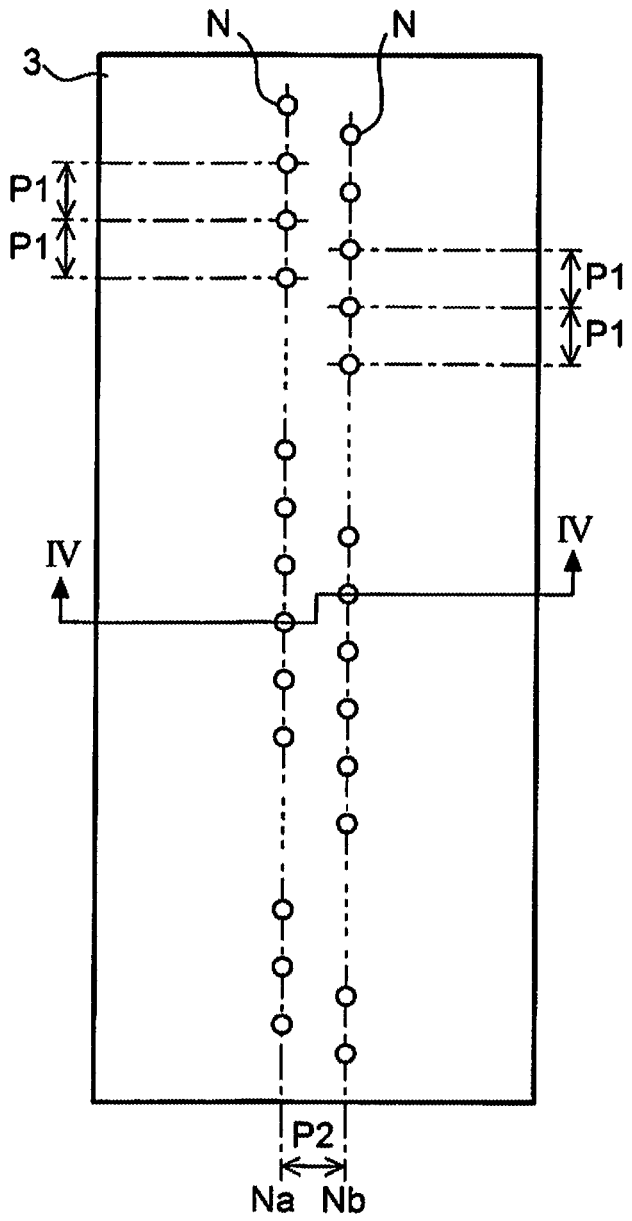
FIG. 3 is a diagram illustrating the enlarged array of the nozzles.

FIG. 3 is a diagram illustrating an array of nozzles in the single head unit 3.

As illustrated in FIG. 3, in the single head unit 3, a plurality of nozzles N are arranged in two rows. Here, for convenience of explanation, the two rows are respectively referred to as nozzle rows Na and Nb.

In each of the nozzle rows Na and Nb, a plurality of nozzles N are arranged at pitches P1 along the Y direction, which is the sub-scanning direction. In addition, the nozzle rows Na and Nb are separated from each other by a pitch P2 in the X direction. The nozzles N of the nozzle row Na are shifted relatively to the respective nozzles N of the nozzle row Nb by half the pitch P1 in the Y direction.

As described above, when the nozzles N in the nozzle row Na are shifted from the respective nozzles N in the nozzle row Nb by half the pitch P1 in the Y direction, the resolution in the Y direction can be substantially doubled compared with a case of a single nozzle row being provided.

For convenience, it is assumed that the number of nozzles N in the single head unit 3 is m (m is an integer of two or more).

As described later, in the head unit 3, a chip-on-film (COF) is connected between an actuator substrate including m nozzles N and piezoelectric elements provided to correspond to respective m nozzles N, and a circuit substrate on which various elements are mounted. Therefore, for convenience of explanation, a structure of the actuator substrate is described below.

In the description, "connection" denotes a direct or indirect connection between two or more elements and includes a case in which one or more intermediate elements exist between the two or more elements.

Figure 4:
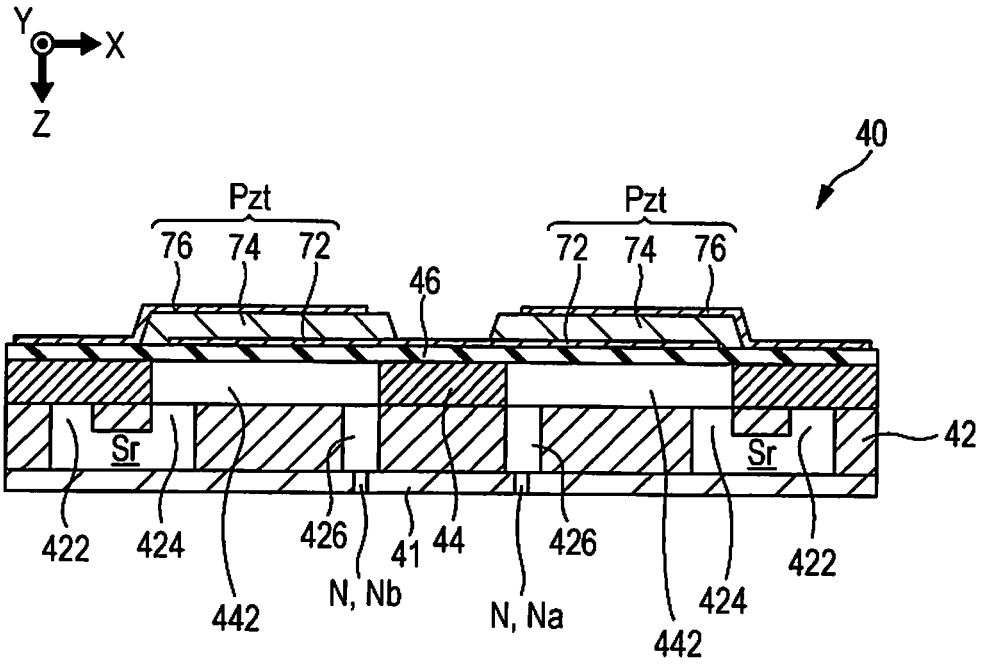
FIG. 4 is a sectional view illustrating a main part configuration in the head unit.

FIG. 4 is a sectional view illustrating the structure of the actuator substrate. Specifically, FIG. 4 is a diagram illustrating a cross section of the actuator substrate when taken along a line IV-IV in FIG. 3.

As illustrated in FIG. 4, an actuator substrate 40 has a structure in which a pressure chamber substrate 44 and a diaphragm 46 are provided on the surface of the negative side in the Z direction of a flow channel substrate 42 and in which a nozzle plate 41 is provided on the surface of the positive side in the Z direction of the flow channel substrate 42.

Schematically, each of the elements of the actuator substrate 40 is a substantially flat-shaped plate member elongated in the Y direction, and for example, the elements are fixed to each other by an adhesive or the like. In addition, each of the flow channel substrate 42 and the pressure chamber substrate 44 is formed, for example, of a single crystal silicon substrate.

The nozzles N are formed on the nozzle plate 41. There is a relationship in which the structure corresponding to the nozzles of the nozzle row Na is shifted relative to the structure corresponding to the nozzles of the nozzle row Nb by half the pitch P1 in the Y direction, but the structures are substantially symmetrical when not shifted, and the structure of the actuator substrate 40 is described below by using the nozzle row Na as an example.

The flow channel substrate 42 is a flat plate-like member that constitutes a flow channel of ink, and an opening section 422, a supply flow channel 424, and a communication flow channel 426 are formed in the flow channel substrate 42. Each of the nozzles has a corresponding flow channel 424 and communication flow channel 426, the opening section 422 spans two or more nozzles, and ink of a corresponding color is supplied to the opening section 422. The opening section 422 functions as a liquid reservoir Sr, and the bottom of the liquid reservoir Sr is constituted, for example, by the nozzle plate 41. Specifically, the nozzle plate 41 is fixed to the bottom of the flow channel substrate 42 so as to close the opening section 422, the supply flow channels 424, and the communication flow channels 426.

The diaphragm 46 is provided on the surface of the pressure chamber substrate 44, which is the surface opposite to a surface where the flow channel substrate 42 is provided. The diaphragm 46 is a flat plate member that can be elastically vibrated and is constituted, for example, by layered elastic membrane formed of an elastic material such as silicon oxide and insulating film formed of an insulating material such as zirconium oxide. The diaphragm 46 and the flow channel substrate 42 are disposed so as to be separated from each other and face each other across the opening sections 422 in the pressure chamber substrate 44. Spaces between the flow channel substrate 42 and the diaphragm 46 inside the opening sections 422 function as cavities 442, each of which applies pressure to ink. Each of the cavities 442 communicates with a corresponding nozzle through the communication flow channel 426 of the flow channel substrate 42.

A piezoelectric element Pzt is formed for each of the nozzles N (cavities 442) on the surface of the diaphragm 46, which is adjacent to the pressure chamber substrate 44.

The piezoelectric element Pzt includes a drive electrode 72 that is common to two or more piezoelectric elements Pzt and formed on the surface of the diaphragm 46, a piezoelectric body 74 formed on the surface of the drive electrode 72, and a drive electrode 76 formed on the surface of the piezoelectric body 74 for each of the piezoelectric elements Pzt. In such a configuration, the region in which the drive electrodes 72 and 76 face each other with the piezoelectric body 74 in between functions as the piezoelectric element Pzt.

The piezoelectric body 74 is formed, for example, in a process including heating (firing). Specifically, the piezoelectric body 74 is formed by firing a piezoelectric material applied to the surface of the diaphragm 46, on which two or more drive electrodes 72 are formed, by heating in a firing furnace and molding the piezoelectric material (for example, by milling using plasma) for each of the piezoelectric elements Pzt.

Similarly, the piezoelectric element Pzt corresponding to the nozzle row Nb include a drive electrode 72, a piezoelectric body 74, and a drive electrode 76.

In addition, in this example, it is assumed that, using the piezoelectric body 74 as a reference, the common drive electrode 72 corresponds to a lower layer, and the individual drive electrode 76 corresponds to an upper layer, but it may be assumed that the drive electrode 72 corresponds to an upper layer, and the drive electrode 76 corresponds to a lower layer, and vice versa.

A voltage Vout of a drive signal corresponding to an amount of ink to be ejected is applied to the drive electrode 76, which is one end of the piezoelectric element Pzt, from the circuit substrate, and a holding signal of a voltage $V_{BS}$ is applied to the drive electrode 72, which is the other end of the piezoelectric element Pzt.

Therefore, the piezoelectric element Pzt is displaced upward or downward depending on the voltages that have been applied to the drive electrodes 72 and 76. Specifically, the central portion of the piezoelectric element Pzt bends upward relatively to both end portions when the voltage Vout of the drive signal applied through the drive electrode 76 decreases, and bends downward when the voltage Vout increases.

Here, when the central portion bends upward, the internal volume of the cavity 442 is increased (the pressure is reduced), such that ink is drawn from the liquid reservoir Sr, and when the central portion bends downward, the internal volume of the cavity 442 is reduced (the pressure is increased), such that ink is ejected from the nozzle N in accordance with the degree of the reduction. As described above, when an appropriate drive signal is applied to the piezoelectric element Pzt, ink is ejected from the nozzle N in response to the displacement of the piezoelectric element Pzt. Therefore, an ejection section that ejects ink is constituted by at least the piezoelectric element Pzt, the cavity 442, and the nozzle N.

An electrical configuration of the printing apparatus 1 is described below.

Figure 5:
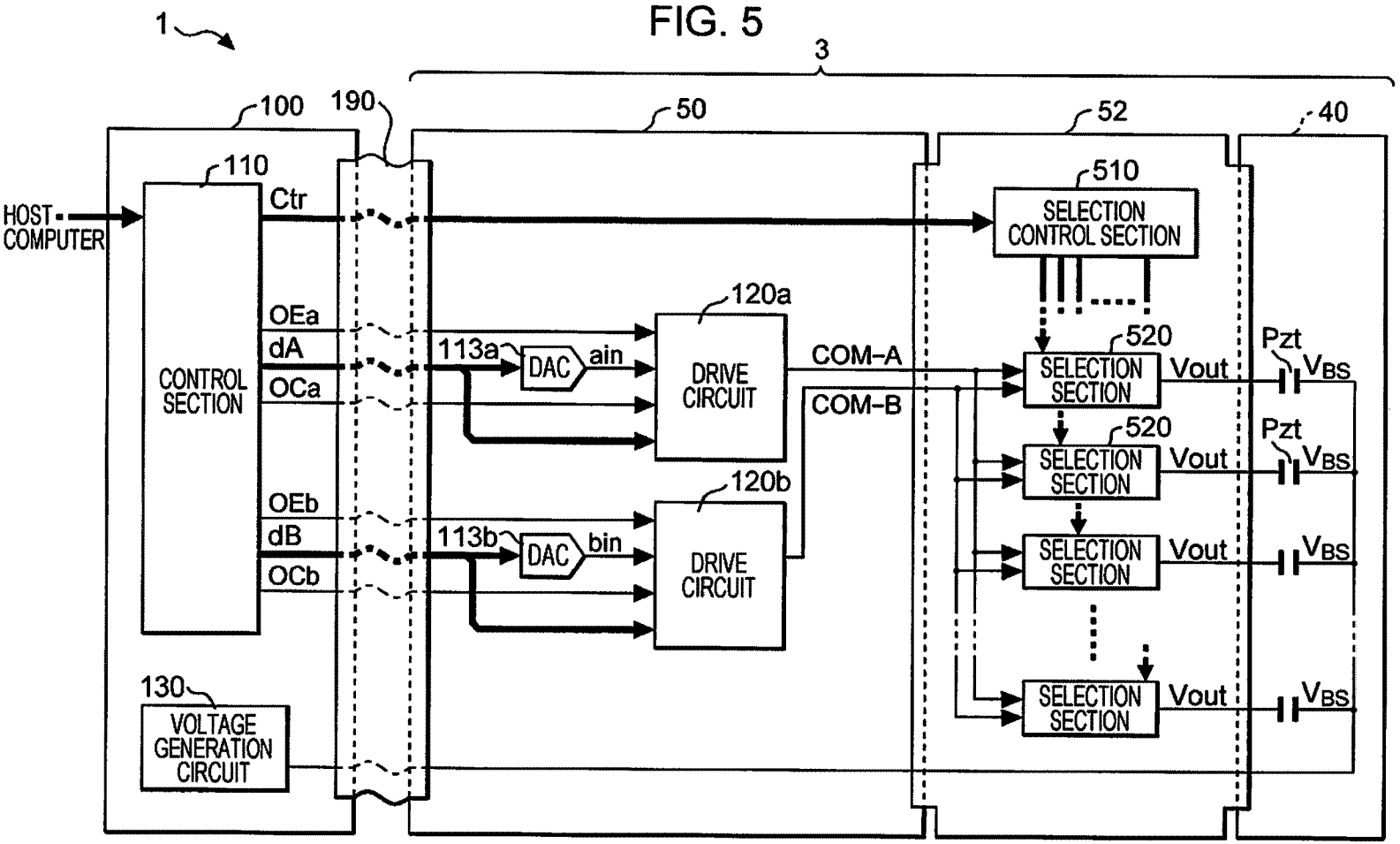
FIG. 5 is a block diagram illustrating an electrical configuration of the printing apparatus.

FIG. 5 is a block diagram illustrating the electrical configuration of the printing apparatus 1.

As illustrated in FIG. 5, in the printing apparatus 1, each of the head units 3 is connected to a main substrate 100 through the flexible flat cable 190.

In the printing apparatus 1, four head units 3 are provided, and the main substrate 100 controls each of the four head units 3 independently. The four head units 3 are the same except that different colors of ink are ejected, and therefore, for convenience, a single head unit 3 is representatively described below.

As illustrated in FIG. 5, the main substrate 100 includes a control unit 110 and a voltage generation circuit 130.

Here, the control unit 110 is a type of a microcomputer including a central processing unit (CPU), a random access memory (RAM), a read-only memory (ROM), and the like and executes a specific program and outputs various signals and the like used to control each section of the printing apparatus 1 when image data, which is a print target is supplied from a host computer or the like.

Specifically, first, the control unit 110 supplies data dA and data dB and signals OEa, OCa, OEb, and OCb to a circuit substrate 50.

Here, data dA is waveform data that defines a waveform (voltage) of a drive signal COM-A as a function of time. Each of the signals OEa and OCa is a signal having a logical level corresponding to a voltage change in the waveform of the drive signal COM-A, which is defined by the data dA, and details of the signals OEa and OCa are described later.

Similarly, the data dB is waveform data that defines a waveform of a drive signal COM-B as a function of time. Each of the signals OEb and OCb is a signal having a logical level corresponding to a voltage change in the waveform of the drive signal COM-B, which is defined by the data dB, and details of the signals OEb and OCb are described later.

Second, the control unit 110 supplies various control signals Ctr to the head unit 3 in synchronization with control for the movement mechanism 6 and the transport mechanism 8. The control signal Ctr includes print data SI (ejection control signal) that defines an amount of ink to be ejected from the nozzle N, a clock signal Sck used for transfer of the print data, and signals LAT and CH that define a print cycle or the like.

The control unit 110 controls the movement mechanism 6 and the transport mechanism 8, but such a configuration is already known, and therefore, the description thereof is omitted herein.

The voltage generation circuit 130 generates a holding signal of the voltage $V_{BS}$. The holding signal of the voltage $V_{BS}$ is applied simultaneously to the other ends of the two or more piezoelectric elements Pzt in the actuator substrate 40 and travels through the flexible flat cable 190, the circuit substrate 50, and a COF 52 in this order. The holding signal of the voltage $V_{BS}$ is used to maintain the other ends of the two or more piezoelectric elements Pzt in respective constant states.

In addition, in the head unit 3, the circuit substrate 50 includes digital-to-analog converters (DACs) 113*a* and 113*b* and drive circuits 120*a* and 120*b*.

The DAC 113*a* converts the digital data dA into an analog signal ain and supplies the converted signal to the drive circuit 120*a*. Similarly, the DAC 113*b* converts the digital data dB into an analog signal bin and supplies the converted signal to the drive circuit 120*b*.

Details of the drive circuit 120*a* are described later, but the drive circuit 120*a* amplifies the voltage of the signal ain, for example, to 10 times, increases the drive ability of the signal (by reducing signal impedance), and outputs the signal as the drive signal COM-A in accordance with the signals OEa and OCa and the data dA. Similarly, the drive circuit 120*b* amplifies the voltage of the signal bin to 10 times, increases the drive ability of the signal, and outputs the signal as the drive signal COM-B in accordance with the signals OEb and OCb and the data dB.

When the data dA (dB) is converted by the DAC 113*a* (113*b*), which is a DAC of a low-voltage semiconductor integrated circuit, for example, the signal ain (bin) has a relatively small amplitude of about 0 V to 4 V. In addition, a relatively large voltage amplitude of about 0 to 40 V used to drive the piezoelectric element Pzt sufficiently is needed for the drive signals COM-A (COM-B), which are sources of combinations of the drive signals applied to the piezoelectric element Pzt.

Therefore, the drive circuit 120*a* (120*b*) amplifies the voltage of the signal ain (bin) that has been converted by the DAC 113*a* (113*b*) to 10 times, performs impedance conversion on the amplified voltage, and outputs the voltage as the drive signal COM-A (COM-B), and the drive signal COM-A or COM-B is selected (or neither of the drive signals COM-A and COM-B is selected) in accordance with an amount of ink to be ejected and is applied to one end of the piezoelectric element Pzt.

The drive signals COM-A and COM-B are supplied to each of two or more selection sections 520 in the COF 52. In addition, each of the drive signals COM-A and COM-B (signals ain and bin after analog conversion and before amplification) has a trapezoidal waveform as described later.

In the embodiment, the COF 52 is connected directly to the circuit substrate 50, but the COF 52 may be connected indirectly to the circuit substrate 50 via the flexible flat cable.

In the COF 52, a selection control section 510 controls selection in each of the selection sections 520. Specifically, the selection control section 510 temporarily accumulates print data corresponding to m nozzles (piezoelectric elements Pzt) of the head unit 3, which are supplied from the control unit 110 in synchronization with the clock signal, and instructs each of the selection sections 520 to select the drive signal COM-A or COM-B at a start timing of the print cycle defined by a timing signal in accordance with the print data.

Each of the selection sections 520 selects the drive signal COM-A or COM-B (or select neither of the drive signals COM-A and COM-B) in response to the instruction from the selection control section 510 and applies the selected drive signal to one end of the corresponding piezoelectric element Pzt as the drive signal of the voltage Vout.

In the embodiment, for a single dot, four gradations such as a large dot, a medium dot, a small dot, and a non-record dot are expressed by causing ink to be ejected from a single nozzle N twice at most. In order to express the four gradations, in the embodiment, the two types of the drive signals COM-A and COM-B are prepared, and each print cycle includes a first-half pattern and a second-half pattern. In addition, in the first half or the second half of each of the cycles, the drive signal COM-A or COM-B is selected (or neither of the drive signals COM-A and COM-B is selected) in accordance with a gradation to be expressed and supplied to the piezoelectric element Pzt.

Therefore, first, the drive signals COM-A and COM-B are described, and second, the detailed configurations of the selection control section 510 and the selection section 520 used to select the drive signal COM-A or COM-B are described.

Figure 6:
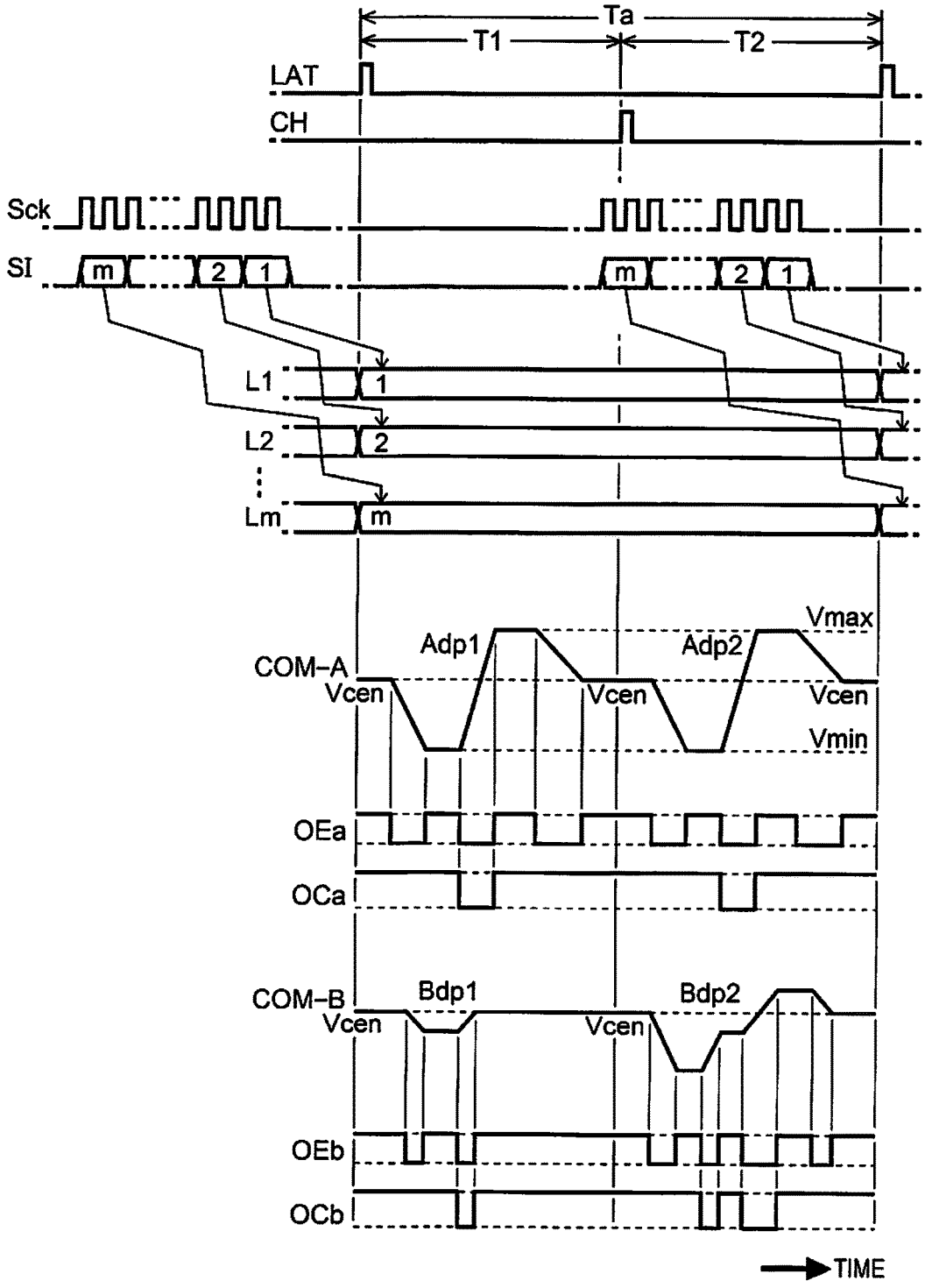
FIG. 6 is a diagram illustrating waveforms and the like of drive signals.

FIG. 6 is a diagram illustrating waveforms and the like of the drive signals COM-A and COM-B.

As illustrated in FIG. 6, the drive signal COM-A has a waveform in which a trapezoidal waveform Adp1 in a time period T1 from output (rise) of the control signal LAT to output of the control signal CH and a trapezoidal waveform Adp2 in a time period T2 from the output of the control signal CH to output of the next control signal LAT in a print cycle Ta are repeated.

In the embodiment, the trapezoidal waveforms Adp1 and Adp2 are substantially the same, and each of the trapezoidal waveforms Adp1 and Adp2 has a waveform in which a specific amount, for example, a medium amount of ink is ejected from a nozzle N corresponding to a piezoelectric element Pzt when the trapezoidal waveform is supplied to the drive electrode 76 that is the one end of the piezoelectric element Pzt.

The drive signal COM-B has a waveform in which the trapezoidal waveform Bdp1 in the time period T1 and the trapezoidal waveform Bdp2 in the time period T2 are repeated. In the embodiment, the trapezoidal waveforms Bdp1 and Bdp2 have different waveforms. Here, the trapezoidal waveform Bdp1 is a waveform used to prevent viscosity of ink near the nozzle N from increasing, by vibrating the ink slightly. Therefore, even when the trapezoidal waveform Bdp1 is supplied to the one end of the piezoelectric element Pzt, ink drop is not ejected from the nozzle N corresponding to the piezoelectric element Pzt. In addition, the trapezoidal waveform Bdp2 has a waveform different from that of the trapezoidal waveform Adp1 (Adp2). The trapezoidal waveform Bdp2 is a waveform used to cause ink having an amount smaller than the above-described specific amount to be ejected from the nozzle N corresponding to the piezoelectric element Pzt when the trapezoidal waveform Bdp2 is supplied to the one end of the piezoelectric element Pzt.

Voltages at a start timing of the trapezoidal waveforms Adp1, Adp2, Bdp1, and Bdp2 and voltages at an end timing of the waveforms Adp1, Adp2, Bdp1, and Bdp2 are the same at a voltage Vcen (intermediate voltage). That is, each of the trapezoidal waveforms Adp1, Adp2, Bdp1, and Bdp2 has a waveform in which the voltage starts at the voltage Vcen and ends at the voltage Vcen.

In addition, in each of the drive signals COM-A and COM-B of the trapezoidal waveforms, there are two or more time periods in each of which the voltage is kept constant.

In the drive signal COM-A, there are three values in each of which the voltage is kept constant, which includes the above-described voltage Vcen. The three values are referred to as Vmax, Vcen, and Vmin in order of high level. In the drive signal COM-B, there are four values in each of which the voltage is kept constant, which includes the above-described voltage Vcen.

In the embodiment, the drive signal COM-A (COM-B) is obtained by amplifying the voltage of the signal ain (bin) to 10 times and performing impedance conversion on the amplified voltage, such that the waveform of the signal ain (bin) corresponds to 1/10 of the voltage of the drive signal COM-A (COM-B). The signal ain (bin) is obtained by performing analog conversion on the data dA (dB), such that the voltage waveform of the drive signal COM-A (COM-B) is defined by the control unit 110.

The control unit 110 supplies the signals OEa and OCa respectively having the following logical levels to the drive circuit 120*a*, in accordance with the trapezoidal waveform of the drive signal COM-A (signal ain). Specifically, first, the control unit 110 sets the signal OEa (specification signal) at an L level in a time period in which the voltage decreases and a time period in which the voltage increases for the drive signal COM-A, and sets the signal OEa at an H level over the other time period in which the voltage of the drive signal COM-A is kept constant. Second, the control unit 110 sets the signal OCa at the L level in a time period in which the voltage of the drive signal COM-A increases, and sets the signal OCa at the H level over the other time period.

As a result, in the trapezoidal waveform of the drive signal COM-A, the signal OEa becomes at the H level in the time period in which the voltage is kept constant, and the signal OEa becomes at the L level in the time period in which the voltage changes. In addition, in the time period in which the voltage of the drive signal COM-A changes (that is, the time period in which the signal OEa becomes at the L level), the signal OCa becomes at the H level in the time period in which the voltage decreases, and the signal OCa becomes at the L level in the time period in which the voltage increases.

Similarly, the control unit 110 supplies the signals OEb and OCb respectively having the following logical levels to the drive circuit 120*b*, in accordance with the trapezoidal waveforms of the drive signal COM-B (signal bin). Specifically, first, the control unit 110 sets the signal OEb at the L level in a time period in which the voltage decreases and a time period in which the voltage increases for the drive signal COM-B (signal bin), and sets the signal OEb at the H level over the other time periods in each of which the voltage of the drive signal COM-B is kept constant. Second, the control unit 110 sets the signal OCb at the L level in a time period in which the voltage of the drive signal COM-B increases and sets the signal OCb at the H level over the other time period.

As a result, in the trapezoidal waveforms of the drive signal COM-B, the signal OEb becomes at the H level in the time period in which the voltage is kept constant, and the signal OEb becomes at the L level in the time period in which the voltage changes. In addition, in the time period in which the voltage of the drive signal COM-B changes (that is, the time period in which the signal OEb becomes at the L level), the signal OCb becomes at the H level in the time period in which the voltage decreases, and the signal OCb becomes in the L level in the time period in which the voltage increases.

Figure 7:
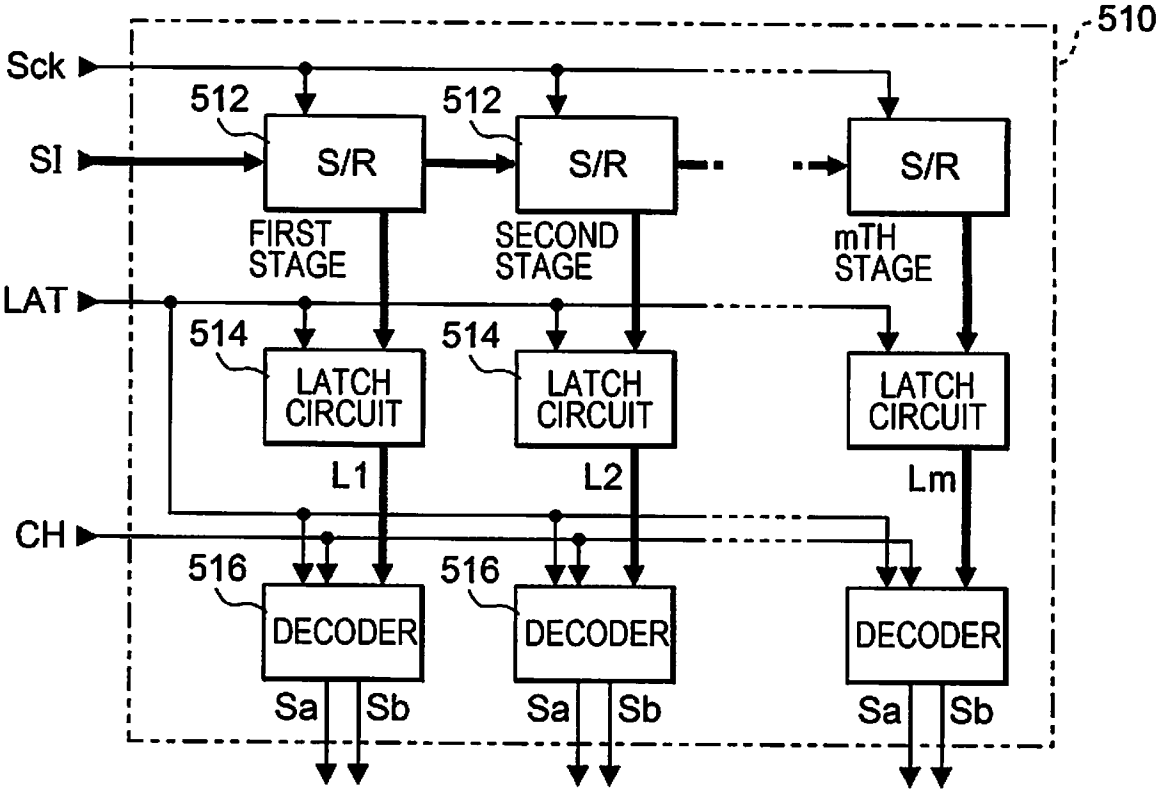
FIG. 7 is a diagram illustrating a configuration of a selection control section.

FIG. 7 is a diagram illustrating a configuration of the selection control section 510 in FIG. 5.

As illustrated in FIG. 7, a clock signal Sck, print data SI, and control signals LAT and CH are supplied to the selection control section 510. In the selection control section 510, a set of a shift register (S/R) 512, a latch circuit 514, and a decoder 516 is provided so as to correspond to each piezoelectric element Pzt (nozzle N).

The print data SI is data that defines a dot to be formed through each of the nozzles N in a target head unit 3 in the print cycle Ta. In the embodiment, in order to express the four gradations such as the non-record dot, the small dot, the medium dot, and the large dot, the print data having a single nozzle portion is constituted by two bits including an upper bit (MSB) and a lower bit (LSB).

The print data SI is supplied from the control unit 110 for each of the nozzles N (piezoelectric elements Pzt) in synchronization with the clock signal Sck in accordance with the transport of the medium P. A configuration used to temporarily hold the print data SI having the two bit portion corresponding to the nozzle N corresponds to the shift register 512.

Specifically, cascade connection is performed on the shift registers 512 of the m stages corresponding to the m piezoelectric elements Pzt (nozzles), and the print data SI that has been supplied to the shift register 512 at the first stage illustrated at the left end of FIG. 7 is sequentially transferred to the latter stages (downstream) in accordance with the clock signal Sck.

In FIG. 7, in order to distinguish shift registers 512, the shift registers 512 are respectively referred to as the first stage, the second stage, . . . , and the m stage in order of the upstream, to which the print data SI is supplied first.

The latch circuit 514 latches the print data SI that has been held by the shift register 512, at the time of rising of the control signal LAT.

The decoder 516 decodes the print data SI having the two bit portion, which has been latched by the latch circuit 514, and outputs selection signals Sa and Sb and defines selection in the selection section 520, for each of the time periods T1 and T2 defined by the control signal LAT and the control signal CH.

Figures 8, 9:
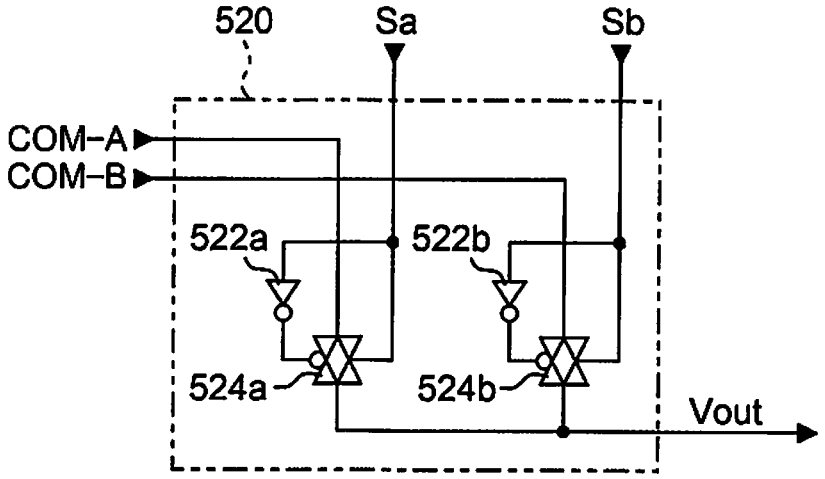
FIG. 8 is diagram illustrating a decode content in a decoder.
FIG. 9 is a diagram illustrating a configuration of a selection section.

FIG. 8 is a diagram illustrating a decode content in the decoder 516.

In FIG. 8, the latched print data SI having the two bit portion is represented as (MSB, LSB). It is indicated that the decoder 516 respectively outputs the logical levels of the selection signals Sa and Sb at the H level and the L level in the time period T1 and outputs the logical levels of the selection signals Sa and Sb at the L level and the H level in the time period T2, for example, when the latched print data SI is (0, 1).

The logical levels of the selection signals Sa and Sb are level-shifted to high amplitude logic by a level shifter (not illustrated) compared with the logical levels of the clock signal Sck, the print data SI, and the control signals LAT and CH.

FIG. 9 is a diagram illustrating a configuration of the selection section 520 in FIG. 5.

As illustrated in FIG. 9, the selection section 520 includes inverters (NOT circuit) 522*a* and 522*b* and transfer gates 524*a* and 524*b*.

The selection signal Sa from the decoder 516 is logically inverted by the inverter 522*a* and supplied to the negative control terminal that is marked with a circle in the transfer gate 524*a* while being supplied to the positive control terminal that is not marked with a circle in the transfer gate 524*a*. Similarly, the selection signal Sb is logically inverted by the inverter 522*b* and supplied to the negative control terminal of the transfer gate 524*b* while being supplied to the positive control terminal of the transfer gate 524*b*.

The drive signal COM-A is supplied to the input terminal of the transfer gate 524*a*, and the drive signal COM-B is supplied to the input terminal of the transfer gate 524*b*. The output terminals of the transfer gates 524*a* and 524*b* are connected to each other, and connected to one end of a corresponding piezoelectric element Pzt.

The transfer gate 524*a* conducts (ON) between the input terminal and the output terminal when the selection signal Sa is at the H level, and does not conduct (OFF) between the input terminal and the output terminal when the selection signal Sa is at the L level. Similarly, the transfer gate 524*b* conduct or not between the input terminal and the output terminal, in accordance with the selection signal Sb.

As illustrated in FIG. 6, the print data SI is supplied for each of the nozzles, in synchronization with the clock signal Sck, and is sequentially transferred in the shift register 512 corresponding to the nozzle. In addition, when the supply of the clock signal Sck is suspended, each of the shift registers 512 is in a state of holding the print data SI corresponding to the nozzle.

Here, when the control signal LAT rises, the latch circuits 514 respectively latch the print data SI held in the shift registers 512 at once. In FIG. 6, numbers in L1, L2, . . . , and Lm respectively denote the pieces of print data SI latched by the latch circuits 514 corresponding to the shift registers 512 at the first stage, the second stage, . . . , and m stage.

The decoder 516 outputs logical levels of the selection signals Sa and Sb in each of the time periods T1 and T2 depending on the size of the dot defined by the latched print data SI as illustrated in the content of FIG. 8.

That is, first, when the print data SI is (1, 1) and defines the size of the large dot, the decoder 516 respectively sets the selection signals Sa and Sb at the H level and the L level in the time period T1 and also respectively sets the selection signals Sa and Sb at the H level and the L level in the time period T2. Second, when the print data SI is (0, 1) and defines the size of the medium dot, the decoder 516 respectively sets the selection signals Sa and Sb at the H level and the L level in the time period T1, and respectively sets the selection signals Sa and Sb at the L level and the H level in the time period T2. Thirdly, when the print data SI is (1, 0) and defines the size of the small dot, the decoder 516 sets both the selection signals Sa and Sb at the L level in the time period T1 and respectively sets the selection signals Sa and Sb at the L level and the H level in the time period T2. Fourthly, when the print data SI is (0, 0) and defines the non-record dot, the decoder 516 respectively sets the selection signals Sa and Sb at the L level and the H level in the time period T1 and sets both the selection signals Sa and Sb at the L level in the time period T2.

Figure 10:
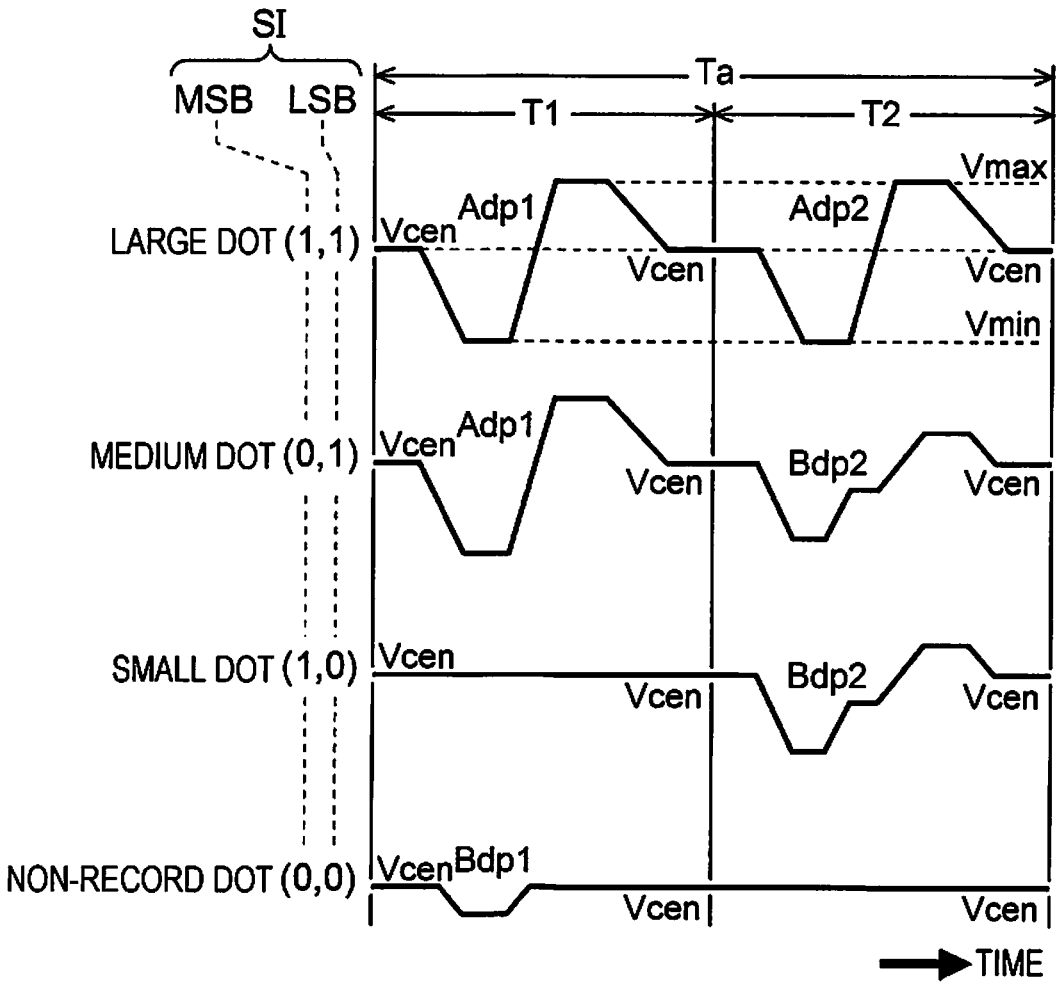
FIG. 10 is a diagram illustrating a drive signal supplied from the selection section to a piezoelectric element.

FIG. 10 is a diagram illustrating the voltage waveform of a drive signal selected in accordance with the print data SI and supplied to the one end of the piezoelectric element Pzt.

When the print data SI is (1, 1), the selection signals Sa and Sb respectively become at the H level and the L level in the time period T1, such that the transfer gate 524*a* is switched on, and the transfer gate 524*b* is switched off. Therefore, the trapezoidal waveform Adp1 of the drive signal COM-A is selected in the time period T1. The selection signals Sa and Sb also respectively becomes at the H level and the L level in the time period T2, such that the selection section 520 selects the trapezoidal waveform Adp2 of the drive signal COM-A.

As described above, when the trapezoidal waveform Adp1 is selected in the time period T1, the trapezoidal waveform Adp2 is selected in the time period T2, and the trapezoidal waveforms Adp1 and Adp2 are supplied to the one end of the piezoelectric element Pzt, ink having a medium amount is ejected twice from the nozzle N corresponding to the piezoelectric element Pzt. Therefore, the ink droplets land and coalesce, and as a result, the large dot as defined by the print data SI is formed on the medium P.

When the print data SI is (0, 1), the selection signals Sa and Sb respectively become at the H level and the L level in the time period T1, such that the transfer gate 524*a* is switched on, and the transfer gate 524*b* is switched off. Therefore, the trapezoidal waveform Adp1 of the drive signal COM-A is selected in the time period T1. Next, the selection signals Sa and Sb respectively become at the L level and the H level in the time period T2, such that the trapezoidal waveform Bdp2 of the drive signal COM-B is selected.

Thus, ink having a medium amount and ink having a small amount are respectively ejected in two separate steps from the nozzle N. Therefore, the ink droplets land and coalesce, and as a result, the medium dot as defined by the print data SI is formed on the medium P.

When the print data SI is (1, 0), both the selection signals Sa and Sb become at the L level in the time period T1, such that the transfer gates 524*a* and 524*b* are switched off. Therefore, neither of the trapezoidal waveforms Adp1 and Bdp1 is selected in the time period T1. When both the transfer gates 524*a* and 524*b* are switched off, a path from the connection point of the output terminals of the transfer gates 524*a* and 524*b* to the one end of the piezoelectric element Pzt becomes in a high-impedance state of not being electrically connected to any part. However, the voltage (Vcen-$V_{BS}$) just before the transfer gate is switched off is maintained at both ends of the piezoelectric element Pzt due to the capacitance characteristic of the piezoelectric element Pzt.

Next, the selection signals Sa and Sb respectively become at the L level and the H level in the time period T2, such that the trapezoidal waveform Bdp2 of the drive signal COM-B is selected. Therefore, ink having a small amount is elected from the nozzle N only in the time period T2, and as a result, the small dot as defined by the print data SI is formed on the medium P.

When the print data SI is (0, 0), the selection signals Sa and Sb respectively become at the L level and the H level in the time period T1, such that the transfer gate 524*a* is switched off, and the transfer gate 524*b* is switched on. Therefore, the trapezoidal waveform Bdp1 of the drive signal COM-B is selected in the time period T1. Next, both the selection signals Sa and Sb become at the L level in the time period T2, such that neither of the trapezoidal waveforms Adp2 and Bdp2 is selected.

Therefore, ink near the nozzle N just vibrates slightly in the time period T1, and the ink is not ejected, and as a result, a dot is not formed, that is, the non-record dot as defined by the print data SI is obtained.

As described above, the selection section 520 selects the drive signal COM-A or COM-B (or select neither of the drive signals COM-A and COM-B), in response to the instruction from the selection control section 510, and applies the selected drive signal to the one of the piezoelectric element Pzt. Therefore, each of the piezoelectric elements Pzt is driven depending on the size of a dot defined by the print data SI.

The drive signals COM-A and COM-B illustrated in FIG. 6 are just examples. In practice, various combinations of waveforms, which have been prepared in advance, are used in accordance with the property of the medium P and the transport speed.

In addition, the example is described above in which the piezoelectric element Pzt bends upward due to a reduction in the voltage, but when the voltages applied to the drive electrodes 72 and 76 are inverted, the piezoelectric element Pzt bends downward due to the reduction in the voltage. Therefore, in the configuration in which the piezoelectric element Pzt bends downward due to the reduction in the voltage, each of the drive signal COM-A and COM-B illustrated in FIG. 10 has the waveform inverted by using the voltage Vcen as a reference.

The drive circuits 120*a* and 120*b* in the circuit substrate 50 are described below.

The drive circuits 120*a* and 120*b* have substantially the same configuration and operation, and the drive circuit 120*a* is described below as an example.

Figure 11:
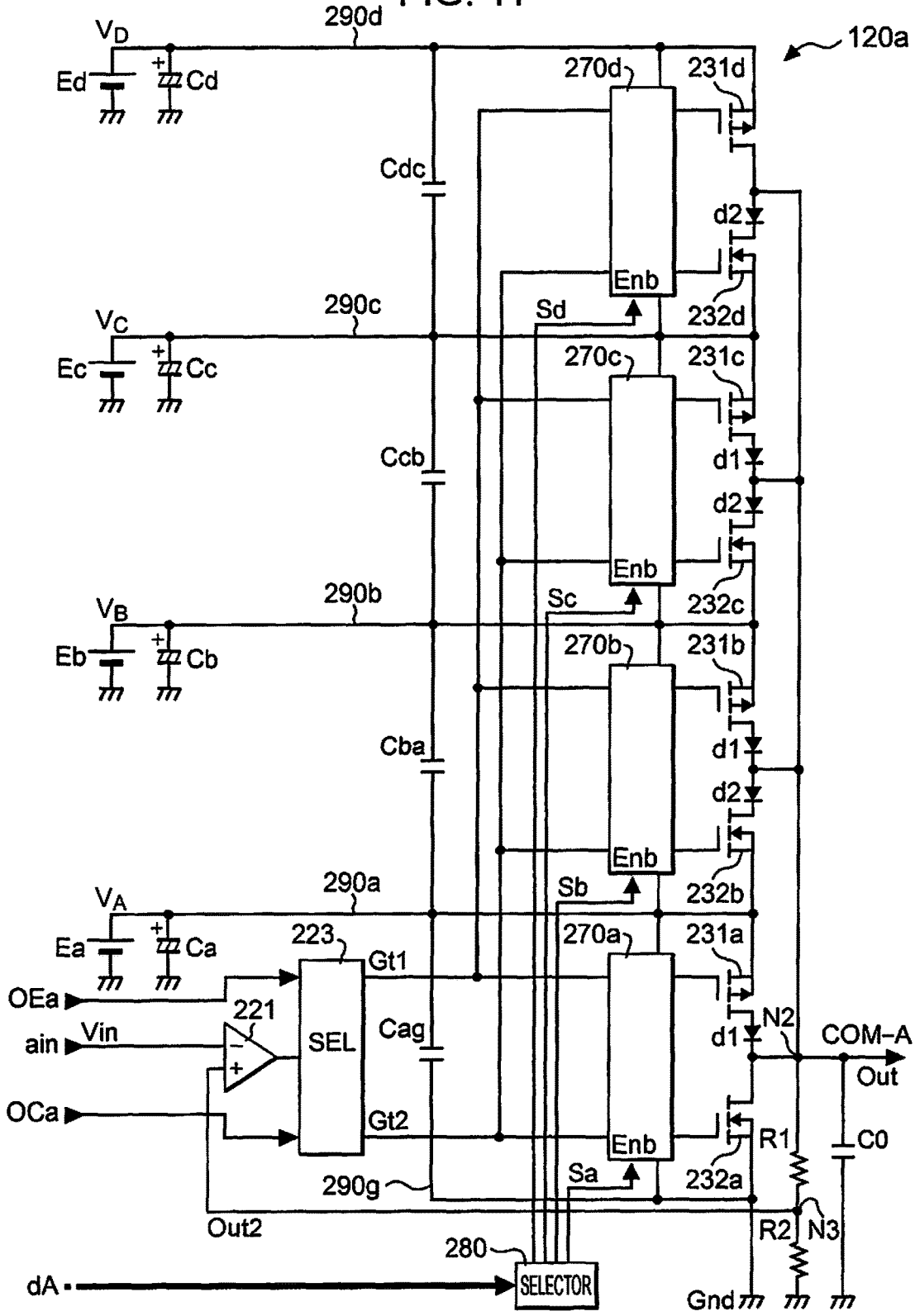
FIG. 11 is a diagram illustrating a configuration of a drive circuit of the printing apparatus.

FIG. 11 is a diagram illustrating the configuration of the drive circuit 120*a*.

As illustrated in FIG. 11, the drive circuit 120*a* includes power sources Ea, Eb, Ec, and Ed, a differential amplifier 221, a selector 223, gate drivers 270*a*, 270*b*, 270*c*, and 270*d*, a selector 280, four transistor pairs, resistors R1 and R2, and capacitors Ca, Cb, Cc, Cd, Cag, Cba, Ccb, Cdc, and C0.

The power source Ea outputs a voltage $V_A$, the power source Eb outputs a voltage $V_B$, the power source Ec outputs a voltage $V_C$, and the power source Ed outputs a voltage $V_D$ in the drive circuit 120*a*.

Figure 12:
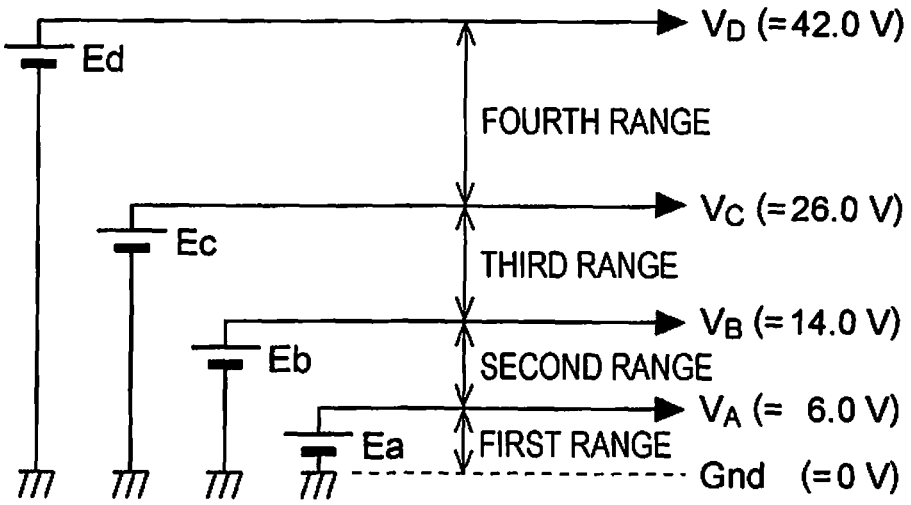
FIG. 12 is a diagram illustrating an operation of the drive circuit.

FIG. 12 is a diagram illustrating the voltages $V_A$, $V_B$, $V_C$, and $V_D$.

As illustrated in FIG. 12, the voltages $V_A$, $V_B$, $V_C$, and $V_D$ are, for example, respectively, 6.0 V, 14.0 V, 26.0 V, and 42.0 V, and the voltage intervals are set unevenly. Specifically, the voltages $V_A$, $V_B$, $V_C$, and $V_D$ are set so that the voltage interval is increased as the voltage becomes high.

In the embodiment, the following voltage ranges are defined by the voltages $V_A$, $V_B$, $V_C$, and $V_D$. That is, a range of a ground Gnd the voltage of which is zero or more and less than the voltage $V_A$ is defined as a first range, a range of the voltage $V_A$ or more and less than the voltage $V_B$ is defined as a second range, a range of the voltage $V_B$ or more and less than the voltage $V_C$ is defined as a third range, and a range of the voltage $V_C$ or more and less than the voltage $V_D$ is defined as a fourth range.

Returning to the description of FIG. 11, the signal ain is supplied to the negative input terminal (−) of the differential amplifier 221, and a voltage Out2 of a node N3 is applied to the positive input terminal (+) of the differential amplifier 221, and the output signal of the differential amplifier 221 is supplied to the selector 223. Due to such a configuration, the differential amplifier 221 amplifies a difference voltage obtained by subtracting the voltage Vin of the signal ain, which is an input, from the voltage Out2 and supplies the amplified difference voltage to the selector 223.

Although not illustrated in particular, for example, the differential amplifier 221 sets the high-side power source at the voltage $V_A$ (=6.0 V), and sets the low-side power source at the ground Gnd (=0 V). Therefore, the output voltage has a range from the ground Gnd to the voltage $V_A$.

To the selector 223, the signals OEa and OCa are supplied, in addition to the output signal from the differential amplifier 221. When the signal OEa is at the L level and the signal OCa is at the H level (first case), the selector (selection section) 223 selects the H level for a signal Gt1, and selects the output signal of the differential amplifier 221 as a signal Gt2. In addition, when the signal OEa at the L level and the signal OCa is at the L level (second case), the selector 223 selects the output signal of the differential amplifier 221 as the signal Gt1, and selects the L level for the signal Gt2. When the signal OEa is at the H level, the selector 223 selects the H level for the signal Gt1 and selects the L level for the signal Gt2 regardless of the logical level of the signal OCa.

The selector 280 determines a voltage range of the signal ain, based on the data dA supplied from the control unit 110 (see FIG. 5), and outputs the selection signals Sa, Sb, Sc and Sd in accordance with the determination result as described below.

Specifically, when the voltage defined by the data dA is 0 V or more and less than 0.6 V, that is, when a voltage obtained by amplifying the voltage Vin to 10 times is included in the above-described first range, the selector 280 sets only the selection signal Sa at the H level, and sets the other selection signals Sb, Sc, and Sd at the L level. In addition, when the voltage defined by the data dA is 0.6 V or more and less than 1.4 V, that is, when the voltage obtained by amplifying the voltage Vin to 10 times is included in the above-described second range, the selector 280 sets only the selection signal Sb at the H level and sets the other selection signals Sa, Sc, and Sd at the L level. Similarly, when the voltage defined by the data dA is 1.4 V or more and less than 2.6 V, that is, when the voltage obtained by amplifying the voltage Vin to 10 times is included in the above-described third range, the selector 280 sets only the selection signal Sc at the H level, and sets the other selection signals Sa, Sb, and Sd at the L level, and when the voltage defined by the data dA is 2.6 V or more and less than 4.2V, that is, when the voltage obtained by amplifying the voltage Vin to 10 times is included in the above-described fourth range, the selector 280 sets only the selection signal Sd at the H level and sets the other selection signals Sa, Sb, and Sc at the L level.

Here, for convenience of explanation, the four transistor pairs are described.

In this example, the four transistor pairs are constituted by a pair of transistors 231*a* and 232*a*, a pair of transistors 231*b* and 232*b*, a pair of transistors 231*c* and 232*c*, and a pair of transistors 231*d* and 232*d*.

From among the eight transistors that constitute the four transistor pairs, the high-side transistors 231*a*, 231*b*, 231*c*, and 231*d* are, for example, P-channel field effect transistors, and the low-side transistors 232*a*, 232*b*, 232*c*, and 232*d* are, for example, N-channel field effect transistors.

The source terminal of the transistor 231*a* is connected to a feeder line 290*a* that feeds the voltage $V_A$, and the source terminal of the transistor 232*a* is connected to a feeder line 290*g* of the ground Gnd. The source terminal of the transistor 231*b* is connected to a feeder line 290*b* that the voltage $V_B$, and the source terminal of the transistor 232*b* is connected to the feeder line 290*a*. The source terminal of the transistor 231*c* is connected to a feeder line 290*c* that feeds the voltage $V_C$, and the source terminal of the transistor 232*c* is connected to the feeder line 290*b*. The source terminal of the transistor 231*d* is connected to a feeder line 290*d* that feeds the voltage $V_D$, and the source terminal of the transistor 232*d* is connected to the feeder line 290*c*.

The drain terminals of the transistor 231*a*, 232*a*, 231*b*, 232*b*, 231*c*, 232*c*, 231*d*, and 232*d* are connected to each other and the connected drain terminals correspond to a node N2. The node N2 is the output terminal of the drive circuit 120*a*, and the voltage of the node N2, that is, the voltage of the drive signal COM-A is referred to as Out.

Diodes d1 and d2 are used for backflow prevention. The forward direction of the diode d1 is a direction from each of the drain terminals of the transistor 231*a*, 231*b*, and 231*c* to the node N2, and the forward direction of the diode d2 is a direction from the node N2 to each of the drain terminals of the transistor 231*b*, 231*c*, and 231*d*.

The voltage Out of the node N2 does not become higher than the voltage $V_D$, and therefore, there is no need to consider backflow. Thus, the diode d1 is not provided for the transistor 231*d*. Similarly, the voltage Out of the node N2 does not become lower than the ground Gnd the voltage of which is zero, and therefore, the diode d2 is not provided for the transistor 232*a*.

In addition, for example, when it is assumed that the transistor 231*a* is a first high-side transistor, the transistor 232*a* is a first low-side transistor, and the transistors 231*a* and 232*a* are a first transistor pair, for example, it is conceived that the transistor 231*b* is a second high-side transistor, the transistor 232*b* is a second low-side transistor, and the transistors 231*b* and 232*b* are a second transistor pair.

In this case, the feeder line 290*g* becomes a first feeder line that doubles as a ground, and the feeder line 290*a* becomes a second feeder line and a third feeder line, and the feeder line 290*b* becomes a fourth feeder line. The second feeder line and the third feeder line may be conceived not as the same feeder line, but as different feeder lines.

It is assumed that, in the gate driver 270*a*, the power sources are at the ground Gnd and the voltage $V_A$, and when the selection signal Sa that has been supplied to the input terminal Enb of the gate driver 270*a* becomes at the H level and the gate driver 270*a* is enabled, the gate driver 270*a* level-shifts the signals Gt1 and Gt2 output from the selector 223, and supplies the signals Gt1 and Gt2 to the respective gate terminals of the transistor 231*a* and the transistor 232*a*. Specifically, when the gate driver 270*a* is enabled, the gate driver 270*a* level-shifts a range from the lowest voltage to the highest voltage of the signal Gt1 to the first range from the ground Gnd to the voltage $V_A$ of the power sources and supplies the signal Gt1 to the gate terminal of the transistor 231*a*, and level-shifts a range from the lowest voltage to the highest voltage of the signal Gt2 to the above-described first range and supplies the signal Gt2 to the gate terminal of the transistor 232*a*.

The ranges from the lowest voltage to the highest voltage of the signals Gt1 and Gt2 are matched with the first range, such that, when the gate driver 270*a* is enabled, the gate driver 270*a* supplies the signal Gt1 to the gate terminal of the transistor 231*a* as is, and supplies the signal Gt2 to the gate terminal of the transistor 232*a* as is.

It is assumed that, in the gate driver 270*b*, the power sources are at the voltage $V_A$ and the voltage $V_B$, and when the gate driver 270*b* is enabled, the gate driver 270*b* level-shifts the range from the lowest voltage to the highest voltage of the signal Gt1 to the second range from the voltage $V_A$ to the voltage $V_B$ of the power sources and supplies the signal Gt1 to the gate terminal of the transistor 231*b*, and level-shifts the range from the lowest voltage to the highest voltage of the signal Gt2 to the above-described second range and supplies the signal Gt2 to the gate terminal of the transistor 232*b*.

Specifically, when the gate driver 270*b* is enabled, the gate driver 270*b* supplies, to the gate terminal of the transistor 231*b*, the voltage obtained by multiplying the voltage of the signal Gt1 by (14−6)/6 and adding 6 V to the multiplied voltage, and supplies, to the gate terminal of the transistor 232*b*, the voltage obtained by multiplying the voltage of the signal Gt2 by (14−6)/6 and adding 6 V to the multiplied voltage.

Similarly, it is assumed that, in the gate driver 270*c*, the power sources are at the voltage $V_B$ and the voltage $V_C$, and when the gate driver 270*c* is enabled, the gate driver 270*c* level-shifts the range from the lowest voltage to the highest voltage of the signal Gt1 to the third range from the voltage $V_B$ to the voltage $V_C$ of the power sources and supplies the signal Gt1 to the gate terminal of the transistor 231*c*, and level-shifts the range from the lowest voltage to the highest voltage of the signal Gt2 to the above-described third range and supplies the signal Gt2 to the gate terminal of the transistor 232*c*. Specifically, when the gate driver 270*c* is enabled, the gate driver 270*c* supplies, to the gate terminal of the transistor 231*c*, the voltage obtained by multiplying the voltage of the signal Gt1 by (26−14)/6, and adding 14 V to the multiplied voltage, and supplies, to the gate terminal of the transistor 232*c*, the voltage obtained by multiplying the voltage of the signal Gt2 by (26−14)/6, and adding 14 V to the multiplied voltage.

Similarly, it is assumed that, in the gate driver 270*d*, the power sources are at the voltage $V_C$ and the voltage $V_D$, when the gate driver 270*d* is enabled, the gate driver 270*d* level-shifts the range from the lowest voltage to the highest voltage of the signal Gt1 to the fourth range from the voltage $V_C$ to the voltage $V_D$ of the power sources and supplies the signal Gt1 to the gate terminal of the transistor 231*d*, and level-shifts the range from the lowest voltage to the highest voltage of the signal Gt2 to the above-described fourth range and supplies the signal Gt2 to the gate terminal of the transistor 232*d*. Specifically, when the gate driver 270*d* is enabled, the gate driver 270*d* supplies, to the gate terminal of the transistor 231*d*, the voltage obtained by multiplying the voltage of the signal Gt1 by (42−26)/6 and adding 26 V to the multiplied voltage, and supplies, to the gate terminal of the transistor 232*d*, the voltage obtained by multiplying the voltage of the signal Gt2 by (42−26)/6 and adding 26 V to the multiplied voltage.

When selection signals that have been supplied to the respective input terminals Enb of the gate drivers 270*a*, 270*b*, 270*c*, and 270*d* become at the L level, and the gate drivers 270*a*, 270*b*, 270*c*, and 270*d* are disabled, each of the gate drivers 270*a*, 270*b*, 270*c*, and 270*d* outputs a signal used to turn off the two corresponding transistors. That is, when the gate drivers 270*a*, 270*b*, 270*c*, and 270*d* are disabled, each of the gate drivers 270*a*, 270*b*, 270*c*, and 270*d* forcibly converts the signal Gt1 at the H level, and forcibly converts the signal Gt2 at the L level.

Here, the H level and the L level are respectively the high-side voltage and the low-side voltage of the power sources in each of the gate drivers 270*a*, 270*b*, 270*c*, and 270*d*. For example, in the gate driver 270*b*, it is assumed that the power sources are set at the voltage $V_B$ and the voltage $V_A$, such that the high-side voltage $V_B$ is at the H level, and the low-side voltage $V_A$ is at the L level.

The drive signal COM-A from the node N2 is fed back to the positive input terminal (+) of the differential amplifier 221 through the resistor R1. In this example, for convenience, the positive input terminal (+) of the differential amplifier 221 is referred to as the node N3, and the voltage of the node N3 is referred to as Out2.

The node N3 is connected to the ground Gnd through the resistor R2. Therefore, the voltage Out2 of the node N3 becomes a voltage obtained by dividing the voltage Out of the node N2 by a ratio defined by the resistance values of the resistors R1 and R2, that is, R2/(R1+R2). In the embodiment, the division ratio is set at 1/10. That is, the voltage Out2 is 1/10 of the voltage Out.

The differential amplifier 221, the selector 223, the gate drivers 270*a*, 270*b*, 270*c*, and 270*d*, and the four transistor pairs constitute an amplifier circuit.

The capacitor Ca is connected to the power source Ea in parallel. Similarly, the capacitor Cb is connected to the power source Eb in parallel, the capacitor Cc is connected to the power source Ec in parallel, and the capacitor Cd is connected to the power source Ed in parallel.

In the embodiment, the following relationship is satisfied between the capacitances of the capacitors Ca, Cb, Cc, and Cd.

$$Ca>Cb>Cc>Cd$$

The capacitors Cag, Cba, Ccb, and Cdc are provided between the feeder lines that are the power sources of the transistor pairs. Specifically, the capacitor Cag is connected between the feeder lines 290*a* and 290*g*, and the capacitor Cba is connected between the feeder lines 290*b* and 290*a*, the capacitor Ccb is connected between the feeder lines 290*c* and 290*b*, and the capacitor Cdc is connected between the feeder lines 290*d* and 290*c*.

In the embodiment, the capacitances of the capacitor Cag, Cba, Ccb, and, Cdc are almost equal to each other, but are about 1/10 to 1/100 compared with the capacitance of the above-described capacitor Cd.

The capacitor C0 is provided for prevention of abnormal oscillation or the like, one end of the capacitor C0 is connected to the node N2, and the other end of the capacitor C0 is connected to the ground Gnd, for example, at a specific potential.

The drive circuit 120*a* that outputs the drive signal COM-A is described above, but a configuration of the drive circuit 120*b* that outputs the drive signal COM-B is similar to that of the drive circuit 120*a*, except for an input/output signal. That is, to the drive circuit 120*b*, the signal OEb is input instead of the signal OEa, the signal OCb is input instead of the signal OCa, and the signal bin is input instead of the signal ain, and in the drive circuit 120*b*, the drive signal COM-B is output through the node N2.

The operations of the drive circuits 120*a* and 120*b* are described below by using the drive circuit 120*a* that outputs the drive signal COM-A as an example.

Figure 13:
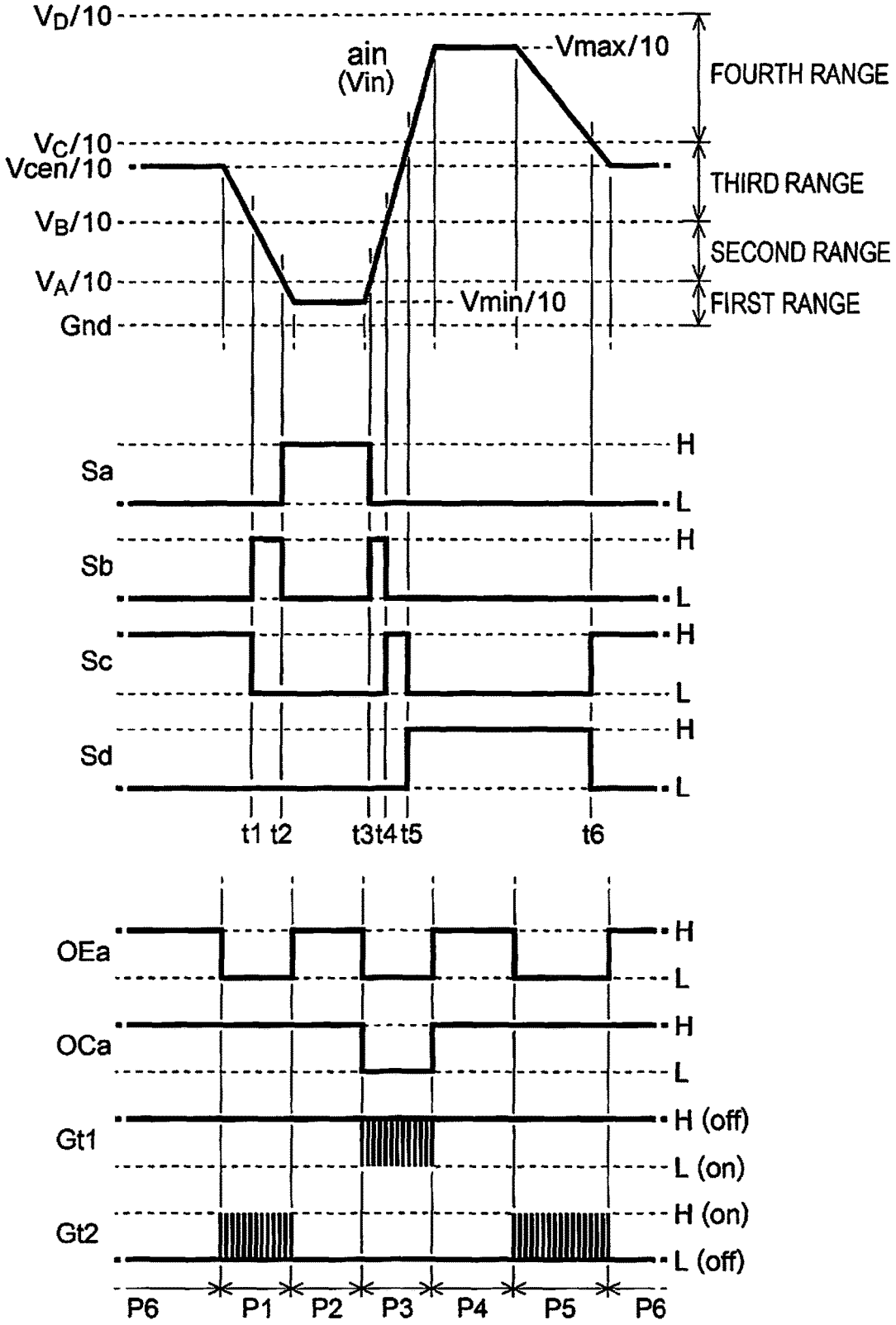
FIG. 13 is a diagram illustrating the operation of the drive circuit.

FIG. 13 is a diagram illustrating a voltage waveform in each section for description of the operation of the drive circuit 120*a*.

As described above, the signal that has been obtained by amplifying the voltage of the signal ain to 10 times is the drive signal COM-A (see FIG. 6), such that the signal ain has a waveform obtained by compressing the drive signal COM-A to 1/10 in the voltage direction. In addition, the drive signal COM-A has a waveform in which the same two trapezoidal waveforms Adp1 and Adp2 are repeated in the print cycle Ta, such that the signal ain also has a similar repetition waveform. FIG. 13 illustrates a single trapezoidal waveform from among such repeated waveforms.

Here, a case is described in which the voltage of the signal ain undergoes a transition as illustrated in FIG. 12. That is, a case is described in which the voltage Vin is in the third range before a timing t1, the voltage Vin is in the second range in a time period from the timing t1 to a timing t2, the voltage Vin is in the first range in a time period from the timing t2 to a timing t3, the voltage Vin is in the second range in a time period from the timing t3 to a timing t4, the voltage Vin is in the third range in a time period from the timing t4 to a timing t5, the voltage Vin is in the fourth range in a time period from the timing t5 to a timing t6, and the voltage Vin is in the third range after the timing t5.

The voltage Vin of the signal ain is 1/10 of the voltage of the drive signal COM-A, and the signal ain is used as a reference, such that the voltage illustrated in FIG. 12 is converted to 1/10 for the first range to the fourth range.

In addition, in FIG. 13, a time period P1 is a time period in which the voltage Vin decreases from the intermediate voltage (Vcen/10) to the lowest voltage (Vmin/10), and a time period P2 following the time period P1 is a time period in which the voltage Vin is kept constant at the lowest voltage, and a time period P3 following the time period P2 is a time period in which the voltage Vin increases from the lowest voltage to the highest voltage Vmax, a time period P4 following the time period P3 is a time period in which the voltage Vin is kept constant at the highest voltage, and a time period P5 following the time period P4 is a time period in which the voltage Vin decreases from the highest voltage to the intermediate voltage (Vcen/10).

For convenience of explanation, the two or more voltage waveforms in FIG. 13 are not necessarily the same in the vertical scale.

First, the time period P1 is the time period in which the voltage of the signal ain decreases. Therefore, in the time period, the signal OEa becomes at the L level, and the signal OCa becomes at the H level, such that the selector 223 selects the H level for the signal Gt1, and selects the output signal of the differential amplifier 221 as the signal Gt2.

In a time period before the timing t1 arrives in the time period P1, only the signal Sc becomes at the H level from among the signals Sa, Sb, Sc, and Sd, such that the gate drivers 270*a*, 270*b*, and 270*d* are disabled. Therefore, the transistor 231*a*, 232*a*, 231*b*, 232*b*, 231*d*, and 232*d* are switched off.

In the time period before the timing t1 arrives, the gate driver 270*c* is enabled, such that the H level is selected for the signal Gt1, and the transistor 231*c* is switched off. In addition, in such a time period, first, the voltage Vin of the signal ain decreases prior to the voltage Out2 that is 1/10 of the voltage Out in the node N2. Conversely speaking, the voltage Out2 becomes the voltage Vin or more. Therefore, the voltage of the output signal of the differential amplifier 221, which is selected as the signal Gt2, increases depending on a difference voltage between the voltage Out2 and the voltage Vin, and typically becomes at the H level. When the signal Gt2 becomes at the H level, the transistor 232*c* is switched off, such that the voltage Out decreases. In practice, the voltage Out does not decrease rapidly but decreases slowly due to the capacitance characteristics of the piezoelectric element Pzt that is a load and the capacitor C0.

When the voltage Out2 becomes smaller than the voltage Vin due to the reduction in the voltage Out, the signal Gt2 becomes at the L level, and the transistor 232*c* is switched off. Even when the transistor 232*c* is switched off, the voltage Out is maintained due to the capacitance characteristics of the piezoelectric element Pzt and the capacitor C0, such that the voltage is kept constant.

When the transistor 232*c* is switched off, the reduction in the voltage Out is suspended, but the reduction in the voltage Vin is continued, such that the voltage Out2 becomes the voltage Vin or more again. Therefore, the signal Gt2 becomes at the H level, and the transistor 232*c* is switched on again.

In the time period before the timing t1 arrives in the time period P1, the signal Gt2 is switched between the H and the L level alternately, such that the transistor 232*c* performs an on/off-repetition operation, that is, a switching operation. Due to the switching operation, the voltage Out2 is controlled to follow the voltage Vin, that is, the voltage Out become voltage obtained by multiplying the voltage Vin by 10 in the third range.

Next, in the time period from the timing t1 to the timing t2 in the time period P1, only the signal Sb becomes at the H level from among the signals Sa, Sb, Sc, and Sd, such that the gate drivers 270*a*, 270*c*, and 270*d* are disabled. Therefore, the transistor 231*a*, 232*a*, 231*c*, 232*c*, 231*d*, and 232*d* are switched off.

In addition, in the time period from the timing t1 to the timing t2 in the time period P1, the gate driver 270*b* is enabled, such that the H level is selected for the signal Gt1, and the transistor 231*b* is switched off.

In addition, even in the time period from the timing t1 to the timing t2, the selector 223 selects the output signal of the differential amplifier 221 as the signal Gt2, such that the transistor 232*b* performs a switching operation similar to the transistor 232*c* before the timing t1 arrives. Due to the switching operation, even in the second range, the voltage Out is controlled to become the voltage obtained by multiplying the voltage Vin by 10.

In a time period after the timing t2 in the time period P1, only the signal Sa becomes at the H level from among the signals Sa, Sb, Sc, and Sd, such that the gate drivers 270*b*, 270*c*, and 270*d* are disabled. Therefore, the transistors 231*b*, 232*b*, 231*c*, 232*c*, 231*d*, and 232*d* are switched off.

In addition, in the time period after the timing t2 in the time period P1, the gate driver 270*a* is enabled, but the H level is selected for the signal Gt1, such that the transistor 231*a* is switched off.

In addition, even in the time period after the timing t2 in the time period P1, the selector 223 selects the output signal of the differential amplifier 221 as the signal Gt2, such that the transistor 232*a* performs a switching operation similar to the transistor 232*c* before the timing t1 arrives and the transistor 232*b* in the time period from the timing t1 to the timing t2. Due to the switching operation, even in the first range, the voltage Out is controlled to become the voltage obtained by multiplying the voltage Vin by 10.

After the timing t2, the time period P2 arrives that is a time period in which the voltage of the signal ain is kept constant. Therefore, in such a time period, the signal OEa becomes at the H level, and the signal OCa also becomes at the H level, such that the selector 223 selects the H level for the signal Gt1 and select the L level as the signal Gt2. Therefore, all the transistors that constitute the four transistor pairs, for example, all the transistors 231*a*, 232*a*, 231*b*, 232*b*, 231*c*, 232*c*, 231*d*, and 232*d* are switched off.

Until the time period P1 ends, the transistor 232*a* performs the switching operation, such that the voltage Out is almost matched with the voltage Vmin obtained by multiplying the voltage Vin by 10 at the time of the start of the time period P2. In the time period P2, even when all the transistors that constitute the four transistor pairs are switched off, the voltage Out of the node N2 is maintained almost at the lowest voltage Vmin due to the capacitance characteristics of the piezoelectric element Pzt and the capacitor C0.

Next, the time period P3 arrives that is a time period in which the voltage of the signal ain increases. Therefore, in the time period, the signal OEa becomes at the L level, and the signal OCa also becomes at the L level, such that the selector 223 selects the output signal of the differential amplifier 221 as the signal Gt1, and selects the L level for the signal Gt2.

In the time period before the timing t3 arrives in the time period P3, only the signal Sa becomes at the H level from among the signals Sa, Sb, Sc, and Sd, such that the gate driver 270*b*, 270*c*, and 270*d* are disabled. Therefore, the transistor 231*b*, 232*b*, 231*c*, 232*c*, 231*d*, and 232*d* are switched off.

In addition, in the time period before the timing t3 arrives in the time period P3, the gate driver 270*a* is enabled, but the L level is selected for the signal Gt2, such that the transistor 232*a* is switched off.

In addition, in the time period before the timing t3 arrives in the time period P3, the voltage Vin of the signal ain increases prior to the voltage Out2 that is 1/10 of the voltage Out in the node N2. Conversely speaking, the voltage Out2 becomes less than the voltage Vin. Therefore, the voltage of the output signal of the differential amplifier 221, which is selected as the signal Gt1, decreases depending on a difference voltage between the voltage Vin and the voltage Out2, and typically becomes at the L level. When the signal Gt1 becomes at the H level, the transistor 231*a* is switched on, such that the voltage Out increases. The voltage Out does not increase rapidly but increases slowly due to the capacitance characteristics of the piezoelectric element Pzt and the capacitor C0.

When the voltage Out2 becomes the voltage Vin or more due to the increase in the voltage Out, the signal Gt1 becomes at the H level, and the transistor 231*a* is switched off. Even when the transistor 231*a* is switched off, the voltage Out is maintained due to the capacitance characteristics of the piezoelectric element Pzt and the capacitor C0, such that the voltage Out is kept constant.

When the transistor 231*a* is switched off, the increase in the voltage Out is suspended, but the increase in the voltage Vin is continued, such that the voltage Out2 becomes less than the voltage Vin again. Therefore, the signal Gt1 becomes at the L level, and the transistor 231*a* is switched on again.

In the time period before the timing t3 arrives in the time period P3, the signal Gt1 is switched between the H level and the L level alternately, such that the transistor 231*a* performs a switching operation. Due to the switching operation, the voltage Out is controlled to become the voltage obtained by multiplying the voltage Vin by 10 in the first range.

Next, in the time period from the timing t3 to the timing t4 in the time period P3, only the signal Sb becomes at the H level, such that the gate drivers 270*a*, 270*c*, and 270*d* are disabled. Therefore, the transistor 231*a*, 232*a*, 231*c*, 232*c*, 231*d*, and 232*d* are switched off.

In addition, in the time period from the timing t3 to the timing t4 in the time period P3, the gate driver 270*b* is enabled, such that the L level is selected for the signal Gt2, and the transistor 232*b* is switched off.

In addition, even in the time period from the timing t3 to the timing t4 in the time period P3, the selector 223 selects the output signal of the differential amplifier 221 as the signal Gt1, such that the transistor 231*b* performs a switching operation similar to the transistor 231*a* before the timing t3 arrives in the time period P3. Due to the switching operation, even in the second range, the voltage Out is controlled to become the voltage obtained by multiplying the voltage Vin by 10.

In the time period from the timing t4 to the timing t5 in the time period P3, only the signal Sc becomes at the H level, such that the voltage Out is controlled to become the voltage obtained by multiplying the voltage Vin by 10 even in the third range by the switching operation of the transistor 231*c*.

In addition, until the time period P3 ends after the timing t5, only the signal Sd becomes at the H level, such that the voltage Out is controlled to become the voltage obtained by multiplying the voltage Vin by 10 due to the switching operation of the transistor 231*d* even in the fourth range.

After the timing t5, the time period P4 arrives that is a time period in which the voltage of the signal ain is kept constant. Therefore, in such a time period, the signal OEa becomes at the H level, and the signal OCa becomes at the H level, such that all the transistors that constitute the four transistor pairs are switched off similar to the time period P2.

The transistor 231*a* performs the switching operation until the time period P3 ends, such that the voltage Out is almost matched with the voltage Vmax obtained by multiplying the voltage Vin by 10 at the time of the start of the time period P4. Therefore, the voltage Out of the node N2 is maintained almost at the highest voltage Vmax due to the capacitance characteristics of the piezoelectric element Pzt and the capacitor C0.

The time period P5 arrives after the time period P4. The time period P5 is a time period in which the voltage of the signal ain decreases, such that an operation similar to the time period P1 is performed. In the time period before the timing t6 arrives in the time period P5, only the signal Sd becomes at the H level, such that the voltage Out is controlled to become the voltage obtained by multiplying the voltage Vin by 10 due to the switching operation of the transistor 232*d* in the fourth range.

In addition, until the time period P5 ends after the timing t6, only the signal Sc becomes at the H level, such that the voltage Out is controlled to become the voltage obtained by multiplying the voltage Vin by 10 due to the switching operation of the transistor 232*c* in the third range.

After the timing t6, a time period P6 arrives that is the time period in which the voltage of the signal ain is kept constant, such that all the transistors that constitute the four transistor pairs are switched off. Until the time period P5 ends, the transistor 232*c* performs the switching operation, such that the voltage Out is almost matched with the voltage Vcen obtained by multiplying the voltage Vin by 10 at the time of the start of the time period P6. Therefore, the voltage Out of the node N2 is maintained almost at the intermediate voltage Vcen due to the capacitance characteristics of the piezoelectric element Pzt and the capacitor C0.

The operation of the drive circuit 120*a* that outputs the drive signal COM-A is described above, but an operation of the drive circuit 120*b* that outputs the drive signal COM-B is similar to that of the drive circuit 120*a*. The waveform of the drive signal COM-B, and the signals OEb and OCb for the waveform are as described in FIG. 6, and the drive circuit 120*b* also performs an operation to output the drive signal COM-B of the voltage Vout obtained by amplifying the voltage of the signal bin to 10 times.

As compared with the class D amplification in which the transistor always performs switching, in the drive circuit 120*a* (120*b*), all the transistors that constitute the four transistor pairs are switched off in the time periods P2, P4, and P6 in each of which the voltage Vin is kept constant. In addition, in the class D amplification, a low pass filter (LPF) that demodulates a switching signal, in particular, an inductor such as a coil is needed, but in the drive circuit 120*a* (120*b*), such a LPF is not needed. Therefore, as compared with the class D amplification, in the drive circuit 120*a* (120*b*), the power consumed by the switching operation and the LPF can be suppressed, and simplification and miniaturization of the circuit can be realized.

Here, when it is assumed that the capacitance in the capacitive load such as the piezoelectric element Pzt is denoted C, and the voltage amplitude is denoted as E, energy P accumulated in the capacitive load is expressed as follows.

$$P=(C\cdot E^2)/2$$

The piezoelectric element Pzt works in response to displacement caused by the energy P, but a work amount in which ink is caused to be ejected is 1% or less for the energy P, and can be ignored for the whole energy P. Therefore, the piezoelectric element Pzt can be simply regarded as a capacitor when viewed from the drive circuits 120*a* and 120*b*. When the capacitor having such a capacitance C is charged, energy equivalent to the following formula is consumed by a charging circuit.

$$(C\cdot E^2)/2$$

The equivalent energy is also consumed by a discharging circuit when the capacitor is discharged.

When the piezoelectric element Pzt is charged from zero to the 42 V simply, that is, not at multi-stages but at once, energy P needed for charging of the piezoelectric element Pzt is obtained based on the following formula.

$$P = C\cdot 42^2/2$$

$$= 882C$$

On the contrary, in the embodiment, when the piezoelectric element Pzt is charged from zero to 42 V, the piezoelectric element Pzt is charged by the drive circuit 120*a* (120*b*) through the following four stages:

Stage from zero to the voltage $V_A$ (6.0 V),

Stage from the voltage $V_A$ to the voltage $V_B$ (14.0 V),

Stage from the voltage $V_B$ to the voltage $V_C$ (26.0 V), and

Stage from the voltage $V_C$ to the voltage $V_D$ (42.0 V).

In this case, only energy P obtained based on the following equation is needed for the charging through the four stages.

$$P = C\cdot 6^2/2 + C\cdot 8^2/2 + C\cdot 12^2/2 + C\cdot 16^2/2 = 250C \quad (1)$$

As described above, in the embodiment, when the capacitive load such as the piezoelectric element Pzt is driven, the electric power to be consumed can be reduced. The charging is described above as an example, but the discharging is also similar to the example of the charging.

In a case in which the capacitive load is charged at multiple stages, when the capacitance C is kept constant, the power consumption can be effectively suppressed by setting voltages at the respective stages at equal intervals, that is, causing the voltage width to be kept constant. However, the actual capacitance of the piezoelectric element Pzt has voltage dependence, and greatly varies depending on the applied voltage.

Figure 14:
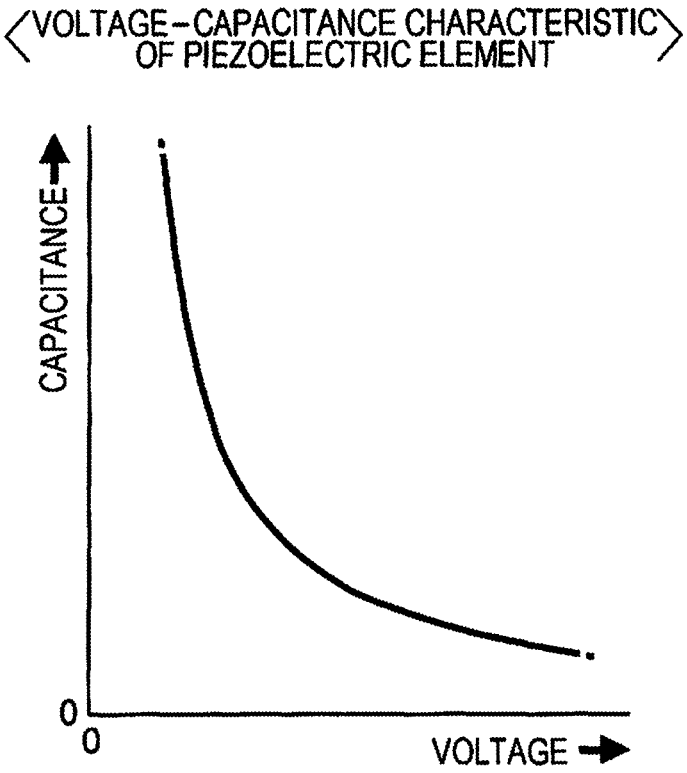
FIG. 14 is diagram illustrating an example of voltage-capacitance characteristics of the piezoelectric element.

FIG. 14 is a diagram illustrating a capacitance characteristic for an applied voltage in the piezoelectric element Pzt.

As illustrated in FIG. 14, there is a characteristic in which the capacitance of the piezoelectric element Pzt is reduced as the applied voltage increases. Briefly speaking, the capacitance in the piezoelectric element Pzt when the high voltage is applied is smaller than the capacitance in the piezoelectric element Pzt when the low voltage is applied. That is, when the piezoelectric element Pzt is charged and discharged with the same voltage width, the capacitance C is reduced as the applied voltage increases, such that the power consumption can be small, but the capacitance C increases as the applied voltage decreases, such that the power consumption becomes relatively large even in the charging and the discharging with the same voltage width.

Therefore, in the embodiment, in a case in which the capacitive load is charged and discharged at multiple stages, the voltage width is increased when the applied voltage of the piezoelectric element Pzt is high, and the voltage width is reduced when the applied voltage of the piezoelectric element Pzt is low. Here, for the piezoelectric element Pzt, it is assumed that the capacitances are referred to as follows:

Capacitance at the time of application of the voltage in the first range is referred to as $C_{A0}$, Capacitance at the time of application of the voltage in the second range is referred to as $C_{BA}$, Capacitance at the time of application of the voltage in the third range is referred to as $C_{CB}$, and Capacitance at the time of application of the voltage in the fourth range is referred to as $C_{DC}$.

Strictly speaking, for example, in the first range, even the capacitance $C_{A0}$ fluctuates depending on the applied voltage, but, for the sake of explanation, it is assumed that the capacitance $C_{A0}$ is an average value in the range. In addition, not zero but the voltage $V_{BS}$ is applied to the other end of the piezoelectric element Pzt, such that the applied voltage of the piezoelectric element Pzt is (Out-$V_{BS}$), but in practice, the voltage $V_{BS}$ is set around zero, and therefore, the influence can be ignored.

Here, as compared with the above-described equation (1), in the embodiment, the energy P needed for the charging through the four stages is obtained as follows.

$$P=C_{A0}\cdot 6^2/2+C_{BA}\cdot 8^2/2+C_{CB}\cdot 12^2/2+C_{DC}\cdot 16^2/2 \quad (2)$$

The following relationship between the capacitances is satisfied due to voltage dependence.

$$C_{A0}>C_{BA}>C_{CB}>C_{DC}$$

Therefore, when products of the voltage and the capacitance in the terms on the right side of the above-described equation (2) are compared with each other, the products can be similar compared with the equation (1), such that the power consumption can be suppressed compared with a case in which the voltage width is kept constant.

In addition, in the drive circuit 120*a* (120*b*), when the voltage of the signal ain (bin) increases, in the transistor pairs the power sources of which correspond to a voltage range of the voltage of the signal ain (bin), the high-side transistor performs the switching operation, and when the voltage of the signal ain (bin) decreases, in the transistor pairs the power sources of which correspond to the voltage range of the voltage of the signal ain (bin), the high-side transistor performs the switching operation.

Due to such a switching operation, high frequency noises are easy to get on the feeder line 290*g*, 290*a*, 290*b*, 290*c*, and 290*d*.

For example, in a case in which the voltage of the signal ain increases, when the voltage of the signal ain is in the first range, the transistor 231*a* performs the switching operation, such that a high frequency noise is easy to get on the feeder line 290*a*. In addition, for example, in a case in which the voltage of the signal ain decreases, when the voltage of the signal ain is in the third range, the transistor 232*c* performs the switching operation, such that a high frequency noise is easy to get on the feeder line 290*b*.

In the embodiment, the capacitors Cag, Cba, Ccb, and Cdc are provided between the feeder lines that are the power sources of the transistor pairs, such that the above-described high frequency noises are absorbed. As a result, in the drive circuit 120*a* (120*b*), an operation in each of the transistor pairs is stabilized.

The feeder line 290*g*, 290*a*, 290*b*, 290*c*, and 290*d* are AC coupled to each other through the capacitors Cag, Cba, Ccb, and Cdc. Therefore, in a case in which the capacitances of the capacitor Cag, Cba, Ccb, and Cdc are increased, when the piezoelectric element is driven by any of the transistors, a current is easily supplied from all the above-described feeder lines, and therefore, the advantage of low power consumption, which is obtained by charging and discharging at multiple stages, is spoiled.

Thus, it is preferable that the capacitors Cag, Cba, Ccb, and Cdc have good high-frequency characteristics enough to absorb the above-described high frequency noises, and respectively have small capacitances.

In addition, in the embodiment, the capacitor Ca, Cb, Cc, and Cd are connected to the respective power sources Ea, Eb, Ec, and Ed in parallel, such as each of the power sources is stabilized.

As described above, the capacitance of the piezoelectric element Pzt increases as the applied voltage is low. That is, when the piezoelectric element Pzt is regarded as a load, it means that the load viewed from the power sources Ea, Eb, Ec, and Ed becomes large as the applied voltage is low.

Therefore, in the embodiment, the following relationship between the capacitances of the capacitor Ca, Cb, Cc, and Cd is satisfied, and the capacitance is caused to be increased as the voltage is low to secure the stability.

$$Ca>Cb>Cc>Cd$$

In the embodiment, for a voltage change in the signal ain (bin), in the transistor pair in a voltage range corresponding to the voltage, a high-side transistor performs the switching operation during the time of increasing of the voltage, and a low-side transistor performs the switching operation during the time of reducing of the voltage, but a linear operation may be performed. Specifically, the high-side transistor during the time of increasing of the voltage or the low-side transistor during the time of reducing of the voltage may control a current that flows between the source and the drain in accordance with the level-shifted gate signal.

The drive signal COM-A (COM-B) output by the drive circuit 120*a* (120*b*) according to the embodiment is not limited to a trapezoidal waveform, and may have a waveform having a continuous slope such as a sine wave. For example, in a case in which the drive circuit 120*a* outputs such a waveform, when a change in the voltage Vin of the signal ain is relatively large, specifically, when the voltage change in a unit of time exceeds a predetermined threshold value, it is sufficient that the signal OEa is set at the L level, the signal OCa is set at the H level during the time of reducing of the voltage, and the signal OCa is set at the L level during the time of increasing of the voltage.

In addition, when a change in the voltage Vin of the signal ain is relatively small, for example, when a voltage change in the unit of time is the above-described threshold value or less, it is sufficient that the signal OEa is set at the H level.

In the drive circuit 120*a* (120*b*), it is assumed that the number of power source voltages for the number of transistor pairs (or the number of gate drivers) is four, but it is sufficient that the number of power source voltages is two or more.

In addition, it is assumed that, in the transistor pair, the high-side transistor 231*a* (231*b*, 232*c*, or 232*d*) is a P-channel type, and the low-side transistor 232*a* (232*b*, 232*c*, or 232*d*) is a N-channel type, but both the transistors 231*a* and 232*a* may be an identical P-channel type or N-channel type. It is necessary that, in accordance with the channel type of the transistor, the output signal by the differential amplifier 221 is inverted or not, and the logical levels of the gate signals when the transistors are forcibly switched off are matched with each other.

In the above embodiment, the print cycle Ta is divided into the time periods T1 and T2, and one of the two types of the drive signals COM-A and COM-B is selected (or neither of the drive signals COM-A and COM-B is selected) in the time period and applied to one end of the piezoelectric element Pzt (multicom), but the number of divisions of the print cycle Ta is not limited to 2, and the number of drive signals is also not limited to 2.

In addition, one or more types of trapezoidal waveforms may be extracted from a single type of drive signal in which two or more different trapezoidal waveforms are repeated in specific order in accordance with the print data SI, and applied to one end of the piezoelectric element Pzt (single-com).

In the above embodiment, the liquid ejecting apparatus is described as the printing apparatus, but a three-dimensional modeling device that ejects liquid and models a solid, a textile printing apparatus that ejects liquid and dyes fabric, or the like may be used.

In addition, the drive circuits 120*a* and 120*b* are provided in the head unit 3, but may be provided in the main substrate 100.

In the configuration in which the drive circuits 120*a* and 120*b* are provided in the main substrate 100, it is necessary that a large amplitude signal is supplied to the head unit 3 through the long flexible flat cable 190, such that it is disadvantageous with power consumption and noise resistance. Conversely, in the configuration in which the drive circuits 120*a* and 120*b* are provided in the head unit 3, it is unnecessary that a large amplitude signal is supplied to the flexible flat cable 190, such that it is advantageous with power consumption and noise resistance.

In addition, in the above embodiment, the piezoelectric element Pzt used to eject ink is described as a drive target of the drive circuits 120*a* and 120*b*, but when it is allowed that the drive circuits 120*a* and 120*b* are apart from the printing apparatus, for example, all loads each having a capacitive component such as an ultrasonic wave motor, a touch panel, an electrostatic speaker, or a liquid crystal panel can be applied as the drive target in addition to the piezoelectric element Pzt.

The entire disclosure of Japanese Patent Application No. 2017-41361, filed Mar. 6, 2017 is expressly incorporated by reference herein.

What is claimed is:

1. A liquid ejecting apparatus comprising:

an amplifier circuit that amplifies a source drive signal by using a first voltage, a second voltage higher than the first voltage, a third voltage higher than the second voltage, and a fourth voltage higher than the third voltage, and outputs an amplified drive signal via a specific output terminal; and an ejection section that includes a piezoelectric element driven by the drive signal and ejects liquid in response to displacement of the piezoelectric element, the amplifier circuit including a first transistor pair, a second transistor pair, a first feeder line to which the first voltage is applied, a second feeder line to which the second voltage is applied, a third feeder line to which the third voltage is applied, a fourth feeder line to which the fourth voltage is applied, a first capacitor, and a second capacitor, wherein the first transistor pair amplifies the source drive signal to have a voltage within a range from the first voltage to the second voltage, the second transistor pair amplifies the source drive signal to have a voltage within a range from the third voltage to the fourth voltage, one end of the first capacitor is connected to the first feeder line and the other end of the first capacitor is connected to the second feeder line, and one end of the second capacitor is connected to the third feeder line and the other end of the second capacitor is connected to the fourth feeder line.

2. The liquid ejecting apparatus according to claim 1, wherein a capacitance of the piezoelectric element in a case where a high voltage is applied to the piezoelectric element is smaller than in a case where a low voltage is applied to the piezoelectric element.

3. The liquid ejecting apparatus according to claim 2, wherein, the amplifier circuit includes a third capacitor one end of which is connected to the second feeder line and the other end of which is connected to a ground, and a capacitance of the third capacitor is larger than a capacitance of the first capacitor.

4. The liquid ejecting apparatus according to claim 3, wherein the amplification circuit includes a fourth capacitor one end of which is connected to the fourth feeder line and the other end of which is connected to the ground, and the capacitance of the third capacitor is larger than a capacitance of the fourth capacitor.

5. The liquid ejecting apparatus according to claim 1, wherein the amplifier circuit includes a differential amplifier that outputs a difference signal obtained by amplifying a difference voltage between the source drive signal and a signal based on the drive signal and a selection section, the first transistor pair includes a first low-side transistor connected between the output terminal and the first feeder line and a first high-side transistor connected between the second feeder line and the output terminal, the second transistor pair includes a second low-side transistor connected between the output terminal and the third feeder line and a second high-side transistor connected between the fourth feeder line and the output terminal, the selection section supplies the difference signal to a gate terminal of the first low-side transistor when a voltage of the source drive signal is in a specific first range in a first case in which the voltage of the source drive signal changes to decrease and a degree of the voltage change exceeds a threshold value, the difference signal to a gate terminal of the first high-side transistor when the voltage of the source drive signal is in the first range in a second case in which the voltage of the source drive signal changes to increase and the degree of the voltage change exceeds the threshold value, the difference signal to a gate terminal of the second low-side transistor when the voltage of the source drive signal is in a second range higher than the first range in the first case, and the difference signal to a gate terminal of the second high-side transistor when the voltage of the source drive signal is in the second range in the second case.

6. The liquid ejecting apparatus according to claim 5, wherein the selection section supplies signals causing the first high-side transistor and the second high-side transistor to respectively switch off to the gate terminals of the first and second high-side transistors in the first case, and signals causing the first low-side transistor and the second low-side transistor to respectively switch off to the gate terminals of the first and second low-side transistors in the second case.

7. The liquid ejecting apparatus according to claim 6, wherein the selection section supplies signals causing the first low-side transistor, the second low-side transistor, a third high-side transistor, and a fourth high-side transistor to the gate terminals of the transistors to respectively switch off when the degree of the voltage change in the source drive signal is the threshold value or less.

8. The liquid ejecting apparatus according to claim 5, wherein the selection section controls each of the signals supplied to the corresponding gate terminal based on a specification signal indicating whether the voltage change in the source drive signal is the threshold value or less.

9. A drive circuit that drives a capacitive load by using a drive signal output from a specific output terminal, the drive circuit comprising:

an amplifier circuit that amplifies a source drive signal that is a source of the drive signal by using a first voltage, a second voltage higher than the first voltage, a third voltage higher than the second voltage, and a fourth voltage higher than the third voltage, and outputs an amplified drive signal through the output terminal, the amplifier circuit including a first transistor pair, a second transistor pair, a first feeder line to which the first voltage is applied, a second feeder line to which the second voltage is applied, a third feeder line to which the third voltage is applied, a fourth feeder line to which the fourth voltage is applied, a first capacitor, and a second capacitor, wherein the first transistor pair amplifies the source drive signal to have a voltage within a range from the first voltage to the second voltage, the second transistor pair amplifies the source drive signal to have a voltage within a range from the third voltage to the fourth voltage, one end of the first capacitor is connected to the first feeder line and the other end of the first capacitor is connected to the second feeder line, and one end of the second capacitor is connected to the third feeder line and the other end of the second capacitor is connected to the fourth feeder line.

* * * * *